US009309872B2

(12) United States Patent
Gonnella et al.

(10) Patent No.: US 9,309,872 B2
(45) **Date of Patent: *Apr. 12, 2016**

(54) SYSTEM AND METHOD FOR POSITION CONTROL OF A MECHANICAL PISTON IN A PUMP

(71) Applicant: Entegris, Inc., Billerica, MA (US)

(72) Inventors: George Gonnella, Pepperell, MA (US); James Cedrone, Braintree, MA (US); Iraj Gashgaee, Marlborough, MA (US)

(73) Assignee: Entegris, Inc., Billerica, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/152,866

(22) Filed: Jan. 10, 2014

(65) Prior Publication Data

US 2014/0127034 A1 May 8, 2014

Related U.S. Application Data

(62) Division of application No. 13/301,516, filed on Nov. 21, 2011, which is a division of application No. 11/602,485, filed on Nov. 20, 2006, now Pat. No. 8,083,498.

(60) Provisional application No. 60/741,660, filed on Dec. 2, 2005, provisional application No. 60/841,725, filed on Sep. 1, 2006.

(51) Int. Cl.
*F04B 13/00* (2006.01)
*F04B 17/03* (2006.01)
(Continued)

(52) U.S. Cl.
CPC ..... *F04B 17/03* (2013.01); *F04B 25/00* (2013.01); *F04B 49/065* (2013.01); *Y10S 417/90* (2013.01)

(58) Field of Classification Search
CPC ..... F04B 17/03; F04B 25/00; F04B 49/065; Y10S 417/90
USPC ..... 417/44.1, 413.1, 274, 900; 222/63; 318/400, 400.37, 400.39, 400.4, 461; 388/800, 805, 812, 804, 820
See application file for complete search history.

(56) References Cited

U.S. PATENT DOCUMENTS 269,626 A 12/1882 Bodel et al.
826,018 A 7/1906 Concoff
(Continued)

FOREIGN PATENT DOCUMENTS

AU B-78872/87 4/1988
CA 1 271 140 7/1990
(Continued)

OTHER PUBLICATIONS

Notice of Allowance for U.S. Appl. No. 13/554,749, mailed Jun. 5, 2014, 3 pgs.
(Continued)

*Primary Examiner* — Devon Kramer
*Assistant Examiner* — Patrick Hamo
(74) *Attorney, Agent, or Firm* — Sprinkle IP Law Group

(57) ABSTRACT

Embodiments of the systems and methods disclosed herein utilize a brushless DC motor (BLDCM) to drive a single-stage or a multi-stage pump in a pumping system for real time, smooth motion, and extremely precise and repeatable position control over fluid movements and dispense amounts, useful in semiconductor manufacturing. The BLDCM may employ a position sensor for real time position feedback to a processor executing a custom field-oriented control scheme. Embodiments of the invention can reduce heat generation without undesirably compromising the precise position control of the dispense pump by increasing and decreasing, via a custom control scheme, the operating frequency of the BLDCM according to the criticality of the underlying function(s). The control scheme can run the BLDCM at very low speeds while maintaining a constant velocity, which enables the pumping system to operate in a wide range of speeds with minimal variation, substantially increasing dispense performance and operation capabilities.

20 Claims, 10 Drawing Sheets

(51) Int. Cl.

| | |
|---|---|
| ***F04B 25/00*** | (2006.01) |
| ***F04B 49/06*** | (2006.01) |

(56) References Cited

U.S. PATENT DOCUMENTS

| | | | |
|---|---|---|---|
| 1,664,125 | A | 3/1928 | Lowrey |
| 2,153,664 | A | 4/1939 | Freedlander |
| 2,215,505 | A | 9/1940 | Hollander |
| 2,328,468 | A | 8/1943 | Laffly |
| 2,456,765 | A | 12/1948 | Borell |
| 2,457,384 | A | 12/1948 | Krenz |
| 2,631,538 | A | 3/1953 | Johnson |
| 2,673,522 | A | 3/1954 | Dickey |
| 2,757,966 | A | 8/1956 | Samiran |
| 3,072,058 | A | 1/1963 | Christopher et al. |
| 3,227,279 | A | 1/1966 | Bockelman |
| 3,250,225 | A | 5/1966 | Taplin |
| 3,327,635 | A | 6/1967 | Sachnik |
| 3,623,661 | A | 11/1971 | Wagner |
| 3,741,298 | A | 6/1973 | Canton |
| 3,895,748 | A | 7/1975 | Klingenberg |
| 3,954,352 | A | 5/1976 | Sakai |
| 3,977,255 | A | 8/1976 | Groleau et al. |
| 4,023,592 | A | 5/1977 | Patzke |
| 4,093,403 | A | 6/1978 | Schrimpf |
| 4,452,265 | A | 6/1984 | Lonnebring |
| 4,483,665 | A | 11/1984 | Hauser |
| 4,541,455 | A | 9/1985 | Hauser |
| 4,597,719 | A | 7/1986 | Tano |
| 4,597,721 | A | 7/1986 | Santefort |
| 4,601,409 | A | 7/1986 | DiRegolo |
| 4,614,438 | A | 9/1986 | Kobayashi |
| 4,671,545 | A | 6/1987 | Miyazaki |
| 4,690,621 | A | 9/1987 | Swain |
| 4,705,461 | A | 11/1987 | Clements |
| 4,797,834 | A | 1/1989 | Honganen et al. |
| 4,808,077 | A | 2/1989 | Kan et al. |
| 4,810,168 | A | 3/1989 | Nogami et al. |
| 4,821,997 | A | 4/1989 | Zdeblick |
| 4,824,073 | A | 4/1989 | Zdeblick |
| 4,865,525 | A | 9/1989 | Kern |
| 4,913,624 | A | 4/1990 | Seki et al. |
| 4,915,126 | A | 4/1990 | Gyllinder |
| 4,943,032 | A | 7/1990 | Zdeblick |
| 4,950,134 | A | 8/1990 | Bailey et al. |
| 4,952,386 | A | 8/1990 | Davison |
| 4,966,646 | A | 10/1990 | Zdeblick |
| 5,061,156 | A | 10/1991 | Kuehne |
| 5,061,574 | A | 10/1991 | Henager, Jr. |
| 5,062,770 | A | 11/1991 | Story |
| 5,064,353 | A | 11/1991 | Tsukahara et al. |
| 5,134,962 | A | 8/1992 | Amada |
| 5,135,031 | A | 8/1992 | Burgess |
| 5,167,837 | A | 12/1992 | Snodgrass |
| 5,192,198 | A | 3/1993 | Gebauer |
| 5,230,445 | A | 7/1993 | Rusnak |
| 5,261,442 | A | 11/1993 | Kingsford |
| 5,262,068 | A | 11/1993 | Bowers |
| 5,312,233 | A | 5/1994 | Tanny et al. |
| 5,316,181 | A | 5/1994 | Burch |
| 5,318,413 | A | 6/1994 | Bertoncini |
| 5,336,884 | A | 8/1994 | Khoshnevisan et al. |
| 5,344,195 | A | 9/1994 | Parimore, Jr. et al. |
| 5,350,200 | A | 9/1994 | Peterson et al. |
| 5,380,019 | A | 1/1995 | Hillery |
| 5,434,774 | A | 7/1995 | Seberger |
| 5,476,004 | A | 12/1995 | Kingsford |
| 5,490,765 | A | 2/1996 | Bailey |
| 5,511,797 | A | 4/1996 | Nikirk |
| 5,516,429 | A | 5/1996 | Snodgrass |
| 5,527,161 | A | 6/1996 | Bailey |
| 5,546,009 | A | 8/1996 | Raphael |
| 5,575,311 | A | 11/1996 | Kingsford |
| 5,580,103 | A | 12/1996 | Hall |
| 5,599,100 | A | 2/1997 | Jackson et al. |
| 5,599,394 | A | 2/1997 | Yabe |
| 5,645,301 | A | 7/1997 | Kingsford |
| 5,652,391 | A | 7/1997 | Kingsford |
| 5,653,251 | A | 8/1997 | Handler |
| 5,743,293 | A | 4/1998 | Kelly |
| 5,762,795 | A | 6/1998 | Bailey |
| 5,772,899 | A | 6/1998 | Snodgrass |
| 5,784,573 | A | 7/1998 | Szczepanek et al. |
| 5,785,508 | A | 7/1998 | Bolt |
| 5,793,754 | A | 8/1998 | Houldsworth et al. |
| 5,839,828 | A | 11/1998 | Glanville |
| 5,846,056 | A | 12/1998 | Dhindsa et al. |
| 5,848,605 | A | 12/1998 | Bailey |
| RE36,178 | E | 4/1999 | Freudinger et al. |
| 5,947,702 | A | 9/1999 | Biederstadt |
| 5,971,723 | A | 10/1999 | Bolt |
| 5,991,279 | A | 11/1999 | Haugli et al. |
| 6,033,302 | A | 3/2000 | Ahmed et al. |
| 6,045,331 | A | 4/2000 | Gehm et al. |
| 6,105,829 | A | 8/2000 | Snodgrass |
| 6,190,565 | B1 | 2/2001 | Bailey |
| 6,203,759 | B1 | 3/2001 | Pelc et al. |
| 6,210,745 | B1 | 4/2001 | Gaughan et al. |
| 6,238,576 | B1 | 5/2001 | Yajima |
| 6,250,502 | B1 | 6/2001 | Cote |
| 6,251,293 | B1 | 6/2001 | Snodgrass |
| 6,298,941 | B1 | 10/2001 | Spadafora |
| 6,302,660 | B1 | 10/2001 | Kurita |
| 6,318,971 | B1 | 11/2001 | Ota |
| 6,319,317 | B1 | 11/2001 | Takamori |
| 6,325,032 | B1 | 12/2001 | Sekiya et al. |
| 6,325,932 | B1 | 12/2001 | Gibson |
| 6,330,517 | B1 | 12/2001 | Dobrowskli |
| 6,348,098 | B1 | 2/2002 | McLoughlin et al. |
| 6,348,124 | B1 | 2/2002 | Garbett |
| 6,474,949 | B1 | 11/2002 | Arai et al. |
| 6,474,950 | B1 | 11/2002 | Waldo |
| 6,478,547 | B1 | 11/2002 | Savard |
| 6,497,817 | B1 | 12/2002 | Liang |
| 6,506,030 | B1 | 1/2003 | Kottke |
| 6,520,519 | B2 | 2/2003 | Howard |
| 6,540,265 | B2 | 4/2003 | Turk |
| 6,554,579 | B2 | 4/2003 | Martin |
| 6,575,264 | B2 | 6/2003 | Spadafora |
| 6,592,825 | B2 | 7/2003 | Pelc |
| 6,635,183 | B2 | 10/2003 | Gibson |
| 6,722,530 | B1 | 4/2004 | King et al. |
| 6,729,501 | B2 | 5/2004 | Peterson |
| 6,742,992 | B2 | 6/2004 | Davis |
| 6,742,993 | B2 | 6/2004 | Savard |
| 6,749,402 | B2 | 6/2004 | Hogan et al. |
| 6,766,810 | B1 | 7/2004 | Van Cleemput |
| 6,767,877 | B2 | 7/2004 | Kuo |
| 6,837,484 | B2 | 1/2005 | Kingsford |
| 6,901,791 | B1 | 6/2005 | Frenz et al. |
| 6,925,072 | B1 | 8/2005 | Grohn |
| 6,952,618 | B2 | 10/2005 | Davlin et al. |
| 7,013,223 | B1 | 3/2006 | Zhang et al. |
| 7,029,238 | B1 | 4/2006 | Zagars |
| 7,063,785 | B2 | 6/2006 | Hiraku et al. |
| 7,083,202 | B2 | 8/2006 | Eberle et al. |
| 7,156,115 | B2 | 1/2007 | Everett et al. |
| 7,175,397 | B2 | 2/2007 | Claude et al. |
| 7,247,245 | B1 | 7/2007 | Proulx et al. |
| 7,249,628 | B2 | 7/2007 | Pillion et al. |
| 7,272,452 | B2 | 9/2007 | Coogan et al. |
| 7,293,967 | B2 | 11/2007 | Fukano |
| 7,383,967 | B2 | 6/2008 | Gibson |
| 7,454,317 | B2 | 11/2008 | Karasawa |
| 7,476,087 | B2 | 1/2009 | Zagars et al. |
| 7,494,265 | B2 | 2/2009 | Niermeyer et al. |
| 7,547,049 | B2 | 6/2009 | Gashgaee |
| 7,684,446 | B2 | 3/2010 | McLoughlin |
| 7,850,431 | B2 | 12/2010 | Gonnella et al. |
| 7,878,765 | B2 | 2/2011 | Gonnella et al. |
| 7,897,196 | B2 | 3/2011 | Cedrone et al. |
| 8,025,486 | B2 | 9/2011 | Gonnella et al. |
| 8,029,247 | B2 | 10/2011 | Cedrone et al. |
| 8,083,498 | B2 | 12/2011 | Gonnella et al. |

(56) References Cited

U.S. PATENT DOCUMENTS

| | | | |
|---|---|---|---|
| 8,087,429 | B2 | 1/2012 | Cedrone et al. |
| 8,172,546 | B2 | 5/2012 | Cedrone et al. |
| 8,292,598 | B2 | 10/2012 | Laverdiere et al. |
| 8,322,994 | B2 | 12/2012 | Claude et al. |
| 8,382,444 | B2 | 2/2013 | Gonnella et al. |
| 8,651,823 | B2 | 2/2014 | Cedrone et al. |
| 8,662,859 | B2 | 3/2014 | Gonnella et al. |
| 8,678,775 | B2 | 3/2014 | Gonnella et al. |
| 8,753,097 | B2 | 6/2014 | Cedrone et al. |
| 8,814,536 | B2 | 8/2014 | Laverdiere et al. |
| 8,870,548 | B2 | 10/2014 | Cedrone et al. |
| 2001/0000865 | A1 | 5/2001 | Gaughen et al. |
| 2001/0014477 | A1 | 8/2001 | Pelc |
| 2002/0044536 | A1 | 4/2002 | Izumi et al. |
| 2002/0095240 | A1 | 7/2002 | Sickinger |
| 2003/0033052 | A1 | 2/2003 | Hillen et al. |
| 2003/0040881 | A1 | 2/2003 | Steger |
| 2003/0143085 | A1 | 7/2003 | Fletcher et al. |
| 2003/0148759 | A1 | 8/2003 | Leliveid |
| 2003/0222798 | A1 | 12/2003 | Floros |
| 2004/0041854 | A1 | 3/2004 | Saito et al. |
| 2004/0050771 | A1 | 3/2004 | Gibson |
| 2004/0072450 | A1 | 4/2004 | Collins |
| 2004/0076526 | A1 | 4/2004 | Fukano et al. |
| 2004/0133728 | A1 | 7/2004 | Ellerbrock et al. |
| 2004/0172229 | A1 | 9/2004 | Aragones et al. |
| 2004/0208750 | A1 | 10/2004 | Masuda |
| 2004/0265151 | A1 | 12/2004 | Bertram |
| 2005/0025634 | A1 | 2/2005 | Bernard et al. |
| 2005/0042127 | A1 | 2/2005 | Ohtsuka et al. |
| 2005/0061722 | A1 | 3/2005 | Takao et al. |
| 2005/0113941 | A1 | 5/2005 | Ii et al. |
| 2005/0126985 | A1 | 6/2005 | Campbell |
| 2005/0147508 | A1 | 7/2005 | Luongo |
| 2005/0151802 | A1 | 7/2005 | Neese et al. |
| 2005/0173458 | A1 | 8/2005 | Hiranaga et al. |
| 2005/0173463 | A1 | 8/2005 | Wesner |
| 2005/0182497 | A1 | 8/2005 | Nakano |
| 2005/0184087 | A1 | 8/2005 | Zagars |
| 2005/0197722 | A1 | 9/2005 | Varone et al. |
| 2005/0232296 | A1 | 10/2005 | Schultze et al. |
| 2005/0238497 | A1 | 10/2005 | Holst |
| 2005/0244276 | A1 | 11/2005 | Pfister et al. |
| 2006/0015294 | A1 | 1/2006 | Yetter et al. |
| 2006/0070960 | A1 | 4/2006 | Gibson |
| 2006/0083259 | A1 | 4/2006 | Metcalf et al. |
| 2006/0184264 | A1 | 8/2006 | Willis et al. |
| 2006/0257707 | A1 | 11/2006 | Kaschmitter et al. |
| 2007/0104586 | A1 | 5/2007 | Cedrone |
| 2007/0125796 | A1 | 6/2007 | Cedrone |
| 2007/0125797 | A1 | 6/2007 | Cedrone |
| 2007/0126233 | A1 | 6/2007 | Gashgaee |
| 2007/0127511 | A1 | 6/2007 | Cedrone |
| 2007/0128046 | A1 | 6/2007 | Gonnella |
| 2007/0128047 | A1 | 6/2007 | Gonnella |
| 2007/0128048 | A1 | 6/2007 | Gonnella |
| 2007/0128050 | A1 | 6/2007 | Cedrone |
| 2007/0206436 | A1 | 9/2007 | Niermeyer et al. |
| 2007/0217442 | A1 | 9/2007 | McLoughlin |
| 2007/0254092 | A1 | 11/2007 | Lin et al. |
| 2008/0036985 | A1 | 2/2008 | Clark et al. |
| 2008/0089361 | A1 | 4/2008 | Metcalf et al. |
| 2008/0131290 | A1 | 6/2008 | Magoon et al. |
| 2009/0047143 | A1 | 2/2009 | Cedrone |
| 2009/0132094 | A1 | 5/2009 | Laverdiere et al. |
| 2011/0051576 | A1 | 3/2011 | Ashizawa et al. |
| 2011/0098864 | A1 | 4/2011 | Gonnella et al. |
| 2012/0057990 | A1 | 3/2012 | Cedrone et al. |
| 2012/0070311 | A1 | 3/2012 | Cedrone et al. |
| 2012/0070313 | A1 | 3/2012 | Gonnella et al. |
| 2012/0091165 | A1 | 4/2012 | Cedrone et al. |
| 2012/0288379 | A1 | 11/2012 | Laverdiere et al. |
| 2013/0004340 | A1 | 1/2013 | Gonnella et al. |
| 2014/0044570 | A1 | 2/2014 | Cedrone et al. |
| 2014/0231318 | A1 | 8/2014 | Cedrone et al. |
| 2014/0322032 | A1 | 10/2014 | Cedrone et al. |
| 2014/0361046 | A1 | 12/2014 | Laverdiere et al. |

FOREIGN PATENT DOCUMENTS

| | | | |
|---|---|---|---|
| CA | 2246826 | | 3/1999 |
| CN | 1321221 | A | 11/2001 |
| CN | 1331783 | A | 1/2002 |
| CN | 1434557 | A | 8/2003 |
| CN | 1526950 | A | 9/2004 |
| CN | 1582203 | | 2/2005 |
| CN | 1590761 | A | 3/2005 |
| CN | 1685156 | | 10/2005 |
| CN | 1695009 | A | 11/2005 |
| DE | 299 09 100 | U1 | 8/1999 |
| DE | 199 33 202 | A1 | 1/2001 |
| EP | 0 249 655 | A | 12/1987 |
| EP | 0 410 394 | A | 1/1991 |
| EP | 0513843 | A1 | 11/1992 |
| EP | 0 261 972 | B1 | 12/1992 |
| EP | 0577104 | A1 | 1/1994 |
| EP | 0 863 538 | A2 | 9/1998 |
| EP | 0 867 649 | A2 | 9/1998 |
| EP | 0 892 204 | A2 | 1/1999 |
| EP | 1 133 639 | B1 | 6/2004 |
| EP | 1 462 652 | A2 | 9/2004 |
| GB | 661 522 | A | 11/1951 |
| GB | 2189555 | A | 10/1987 |
| JP | 54-081119 | | 6/1979 |
| JP | 54-165812 | | 11/1979 |
| JP | 55-073563 | | 6/1980 |
| JP | 58-119983 | | 7/1983 |
| JP | 58-203340 | A | 11/1983 |
| JP | S60-67790 | | 4/1985 |
| JP | S61-73090 | | 5/1986 |
| JP | 61-178582 | | 8/1986 |
| JP | S63-176681 | | 7/1988 |
| JP | 63-255575 | | 10/1988 |
| JP | 02-13184 | | 1/1990 |
| JP | 02-091485 | | 3/1990 |
| JP | H02-227794 | | 9/1990 |
| JP | 04-167916 | | 6/1992 |
| JP | 05-184827 | | 7/1993 |
| JP | 51-081413 | | 7/1993 |
| JP | 6-58246 | | 3/1994 |
| JP | 06-103688 | | 4/1994 |
| JP | H07-253081 | | 10/1995 |
| JP | 08-016563 | | 1/1996 |
| JP | H08-021370 | | 1/1996 |
| JP | 08-61246 | | 3/1996 |
| JP | H08-300020 | | 11/1996 |
| JP | 2633005 | | 4/1997 |
| JP | 10-169566 | | 6/1998 |
| JP | 11-26430 | A | 1/1999 |
| JP | 11-076394 | | 3/1999 |
| JP | 2963514 | | 8/1999 |
| JP | 11-356081 | | 12/1999 |
| JP | 2001-203196 | | 7/2001 |
| JP | 2001-304650 | | 10/2001 |
| JP | 2001-342989 | | 12/2001 |
| JP | 2002-106467 | | 4/2002 |
| JP | 2002-305890 | | 10/2002 |
| JP | 2003-021069 | | 1/2003 |
| JP | 2003-516820 | | 5/2003 |
| JP | 2003-293958 | | 10/2003 |
| JP | 2004-032916 | | 1/2004 |
| JP | 2004-052748 | | 2/2004 |
| JP | 2004-143960 | | 5/2004 |
| JP | 2004-225672 | | 8/2004 |
| JP | 2004-232616 | | 8/2004 |
| JP | 2004-293443 | | 10/2004 |
| JP | 2005-090410 | | 4/2005 |
| JP | 2006-504035 | | 2/2006 |
| JP | 2006161677 | | 6/2006 |
| JP | 2009-517601 | | 4/2009 |
| JP | 2009-517618 | | 4/2009 |
| JP | 2009-517778 | | 4/2009 |
| JP | 2009-517888 | | 4/2009 |

(56) References Cited

FOREIGN PATENT DOCUMENTS

| | | | |
|---|---|---|---|
| JP | 2009-521636 | | 6/2009 |
| TW | 466301 | | 12/2001 |
| TW | 477862 | B | 3/2002 |
| TW | 593888 | | 6/2004 |
| TW | I 225908 | B | 1/2005 |
| WO | WO 96/35876 | A | 11/1996 |
| WO | WO 99/37435 | | 7/1999 |
| WO | WO 99/66415 | A1 | 12/1999 |
| WO | WO 00/31416 | A1 | 6/2000 |
| WO | WO 01/40646 | A3 | 6/2001 |
| WO | WO 0143798 | | 6/2001 |
| WO | WO 02/090771 | A2 | 11/2002 |
| WO | WO 2006/057957 | A2 | 6/2006 |
| WO | WO 2007/067344 | A2 | 6/2007 |
| WO | WO 2007/067359 | A2 | 6/2007 |
| WO | WO 2009/059324 | | 5/2009 |

OTHER PUBLICATIONS

Notice of Allowance for U.S. Appl. No. 13/251,976, mailed Jun. 6, 2014, 5 pgs.
Office Action (with English translation) for Japanese Patent Application No. 2011-168830, mailed Jun. 2, 2014, 9 pgs.
Office Action for U.S. Appl. No. 13/316,093, mailed Jun. 23, 2014, 8 pgs.
Notice of Allowance for Japanese Patent Application No. 2009-539238, dated Jun. 23, 2014, 3 pgs.
Notice of Allowance for Japanese Patent Application No. 2012-059979, dated Jun. 16, 2014, 3 pgs.
Office Action (with English translation) for Japanese Patent Application No. 2013-018339, mailed Aug. 25, 2014, 5 pgs.
Office Action (with English translation) for Japanese Patent Application No. 2012-087168, mailed Aug. 25, 2014, 4 pgs.
English translation of Office Action for Chinese Patent Application No. 201210365592.8, mailed Sep. 12, 2014, 11 pgs.
Office Action for U.S. Appl. No. 13/316,093, mailed Nov. 4, 2014, 6 pgs.
Office Action for U.S. Appl. No. 11/948,585, mailed Aug. 14, 2014, 6 pgs.
Office Action for Chinese Patent Application No. 201210151908.3, dated Apr. 30, 2014, 19 pgs.
Brochure describing a Chempure Pump—A Furon Product, 1996, Furon Company, Anaheim, CA 92806, USA, 2 pgs.
Krishna et al.,"Characterization of Low Viscosity Photoresist Coating," Advances in Resist Tech. and Processing XV (Proceedings of SPIE (The Int'l Society of Optical Engineering), Feb. 23-25, 1998, Santa Clara, CA, vol. 3333 (Part Two of Two Parts), 15 pgs.
English translation only of Office Action for Chinese Patent Application No. 200410079193.0, mailed Mar. 23, 2007, 5 pgs.
International Search Report and Written Opinion, for International Patent Application No. PCT/US2006/045127 mailed May 23, 2007, 7 pgs.
International Search Report and Written Opinion, for International Patent Application No. PCT/US2006/044908 mailed Jul. 16, 2007, 10 pgs.
International Search Report and Written Opinion, for International Patent Application No. PCT/US2006/045175 mailed Jul. 25, 2007, 8 pgs.
International Search Report and Written Opinion, for International Patent Application No. PCT/US2006/044907 mailed Aug. 8, 2007, 9 pgs.
International Search Report and Written Opinion, for International Patent Application No. PCT/US2006/045177 mailed Aug. 9, 2007, 7 pgs.
Office Action for European Patent Application No. 00982386.5 dated Sep. 4, 2007, 8 pgs.
International Search Report and Written Opinion, for International Patent Application No. PCT/US2006/044906 mailed Sep. 5, 2007, 8 pgs.
International Search Report and Written Opinion, for International Patent Application No. PCT/US2005/042127 mailed Sep. 26, 2007, 8 pgs.
International Search Report and Written Opinion, for International Patent Application No. PCT/US2006/044980 mailed Oct. 4, 2007, 9 pgs.
Office Action for U.S. Appl. No. 11/051,576, mailed Dec. 13, 2007, 10 pgs.
International Search Report and Written Opinion, for International Patent Application No. PCT/US2006/045176, mailed Apr. 21, 2008, 8 pgs.
Office Action for U.S. Appl. No. 11/602,513, mailed May 22, 2008, 10 pgs.
International Search Report and Written Opinion, for International Patent Application No. PCT/US2007/05377, mailed Jun. 4, 2008, 13 pgs.
Office Action (with English translation) for Chinese Patent Application No. 2005101088364, dated May 23, 2008, 6 pgs.
International Search Report and Written Opinion for International Patent Application No. PCT/US2006/044985, mailed Jun. 23, 2008, 7 pgs.
International Search Report and Written Opinion for International Patent Application No. PCT/US2007/017017, mailed Jul. 3, 2008, 9 pgs.
International Search Report and Written Opinion for International Patent Application No. PCT/US2006/044981, mailed Aug. 8, 2008, 10 pgs.
Office Action for U.S. Appl. No. 11/365,395, mailed Aug. 19, 2008, 19 pgs.
Office Action for U.S. Appl. No. 11/292,559 mailed Aug. 28, 2008, 19 pgs.
Office Action for U.S. Appl. No. 11/602,513, mailed Nov. 14, 2008, 7 pgs.
Office Action for U.S. Appl. No. 11/364,286, mailed Nov. 14, 2008, 11 pgs.
International Preliminary Report on Patentability, Chap. II, for International Patent Application No. PCT/US2007/017017, mailed Jan. 13, 2009, 8 pgs.
International Preliminary Report on Patentability, Chap. I, for International Patent Application No. PCT/US2006/044981, mailed Nov. 6, 2008, 7 pgs.
International Preliminary Report on Patentability, Chap. II, for International Patent Application No. PCT/US2006/044981, mailed Feb. 2, 2009, 9 pgs.
Office Action for U.S. Appl. No. 11/365,395, mailed Feb. 2, 2009, 18 pgs.
Office Action for U.S. Appl. No. 11/292,559, mailed Dec. 24, 2008, 18 pgs.
International Preliminary Report on Patentability, Chap. I, for International Patent Application No. PCT/US2006/044985, mailed Apr. 9, 2009, 5 pgs.
Office Action for U.S. Appl. No. 11/292,559, mailed Apr. 17, 2009, 20 pgs.
Office Action for U.S. Appl. No. 11/273,091, mailed Feb. 17, 2006, 8 pgs.
Office Action for U.S. Appl. No. 11/273,091, mailed Jul. 3, 2006, 8 pgs.
Office Action for U.S. Appl. No. 11/273,091 mailed Oct. 13, 2006, 8 pgs.
Office Action for U.S. Appl. No. 11/273,091 mailed Feb. 23, 2007, 6 pgs.
Office Action for U.S. Appl. No. 11/273,091 mailed Oct. 15, 2007, 8 pgs.
Office Action for U.S. Appl. No. 11/386,427 mailed Nov. 13, 2007, 11 pgs.
Office Action for U.S. Appl. No. 11/364,286 mailed Jun. 1, 2009, 14 pgs.
International Preliminary Report on Patentability, Chap. I, for International Patent Application No. PCT/US2006/045176, issued on Mar. 31, 2009, 5 pgs.
Written Opinion for Singapore Patent Application No. 200803948-9, dated Jul. 2, 2009, 10 pgs.

(56) References Cited

OTHER PUBLICATIONS

International Search Report for International Patent Application No. PCT/US1999/028002, mailed Mar. 14, 2000, 5 pgs.
Written Opinion for International Patent Application No. PCT/US1999/028002, mailed Oct. 25, 2000, 8 pgs.
International Preliminary Examination Report for International Patent Application No. PCT/US1999/028002, mailed Feb. 21, 2001, 9 pgs.
International Search Report and Written Opinion for International Patent Application No. PCT/US2006/044907, mailed Aug. 8, 2007, 9 pgs.
International Preliminary Report on Patentability, Chap. I, for International Patent Application No. PCT/US2006/044906, mailed Jun. 5, 2008, 7 pgs.
International Preliminary Report on Patentability, Chap. I, for International Patent Application No. PCT/US2006/044907, mailed Jun. 5, 2008, 7 pgs.
International Preliminary Report on Patentability, Chap. I, for International Patent Application No. PCT/US2006/044980, mailed Jun. 12, 2008, 7 pgs.
International Preliminary Report on Patentability, Chap. I, for International Patent Application No. PCT/US2006/044908, mailed Jun. 12, 2008, 8 pgs.
International Preliminary Report on Patentability, Chap. I, for International Patent Application No. PCT/US2006/045175, mailed Jun. 12, 2008, 6 pgs.
International Preliminary Report on Patentability, Chap. I, for International Patent Application No. PCT/US2006/045127, mailed Jun. 12, 2008, 8 pgs.
International Preliminary Report on Patentability, Chap. I, for International Patent Application No. PCT/US2006/045177, mailed Jun. 19, 2008, 5 pgs.
International Preliminary Report on Patentability, Chap. II, for International Patent Application No. PCT/US2007/005377, mailed Oct. 14, 2008, 14 pgs.
European Search Report for European Patent Application No. 06838223.3, dated Aug. 12, 2009, 18 pgs.
Japanese Laid Open Publication No. JP-2009-528631, published Aug. 6, 2009, with International Search Report, 38 pgs.
Office Action for U.S. Appl. No. 09/447,504 mailed Feb. 27, 2001, 4 pgs.
Office Action for U.S. Appl. No. 09/447,504 mailed Nov. 18, 2003, 4 pgs.
Office Action for U.S. Appl. No. 09/447,504 mailed Jul. 13, 2004, 5 pgs.
Japanese Laid Open Publication No. JP-2009-529847, published Aug. 20, 2009, with International Search Report, 21 pgs.
Examination Report for Singapore Patent Application No. 200703671-8 dated Jul. 28, 2009, 4 pgs.
Office Action (with English translation) for Chinese Patent Application No. 200580039961.2, dated Aug. 21, 2009, 33 pgs.
Written Opinion for Singapore Patent Application No. 200806425-5 dated Oct. 14, 2009, 8 pgs.
Office Action for U.S. Appl. No. 11/602,507 mailed Oct. 28, 2009, 12 pgs.
Office Action for U.S. Appl. No. 11/292,559 mailed Nov. 3, 2009, 17 pgs.
Office Action for U.S. Appl. No. 11/364,286 mailed Nov. 9, 2009, 19 pgs.
Office Action (with English translation) for Chinese Patent Appl. No. 200680050665.7, dated Mar. 11, 2010, 6 pgs.
Office Action for U.S. Appl. No. 11/364,286 mailed Apr. 7, 2010, 22 pgs.
Office Action for U.S. Appl. No. 11/292,559 mailed Apr. 14, 2010, 20 pgs.
Office Action for U.S. Appl. No. 11/602,508 mailed Apr. 15, 2010, 20 pgs.
Office Action for Chinese Patent Application No. CN 200680050801.2, mailed Mar. 26, 2010, 13 pgs.
Supplementary European Search Report and Written Opinion for European Patent Application No. EP06838071.6, dated Apr. 28, 2010, 5 pgs.
Office Action for U.S. Appl. No. 11/602,485 mailed Jun. 9, 2010, 9 pgs.
Office Action for U.S. Appl. No. 11/602,507 mailed Jun. 14, 2010, 13 pgs.
Office Action for U.S. Appl. No. 11/602,472 mailed Jun. 18, 2010, 13 pgs.
Office Action for U.S. Appl. No. 11/602,465 mailed Jun. 18, 2010, 14 pgs.
Office Action for U.S. Appl. No. 11/602,464 mailed Jun. 21, 2010, 19 pgs.
Office Action (with English translation) for Chinese Patent Application No. CN 200680045074.0, mailed Jun. 7, 2010, 8 pgs.
Office Action (with English translation) for Chinese Patent Application No. CN 200680050814.X, mailed Aug. 6, 2010, 10 pgs.
Notice of Allowance for U.S. Appl. No. 11/364,286 mailed Sep. 21, 2010, 11 pgs.
Notice of Allowance for U.S. Appl. No. 11/602,507 mailed Oct. 14, 2010, 8 pgs.
Office Action (with English translation) for Chinese Patent Application No. CN 200780046952.5, mailed Sep. 27, 2010, 8 pgs.
Office Action for U.S. Appl. No. 11/602,485 mailed Nov. 19, 2010, 9 pgs.
Notice of Allowance for U.S. Appl. No. 11/602,508, mailed Dec. 14, 2010, 10 pgs.
Office Action (with English translation) for Chinese Patent Application No. 200680051448.X, mailed Dec. 1, 2010, 20 pgs.
Office Action for U.S. Appl. No. 11/602,464 mailed Jan. 5, 2011, 12 pgs.
Notice of Allowance for U.S. Appl. No. 11/602,465, mailed Jan. 12, 2011, 19 pgs.
Office Action (with English translation) for Chinese Patent Application No. 200680050801.2, dated Jan. 6, 2011, 7 pgs.
Notice of Allowance for U.S. Appl. No. 11/602,508, mailed Mar. 4, 2011, 6 pgs.
Office Action (with English translation) for Japanese Patent Application No. 2007-543342, dated Feb. 25, 2011, mailed Mar. 1, 2011, 12 pgs.
Office Action for U.S. Appl. No. 11/602,472, mailed Mar. 21, 2011, 11 pgs.
European Search Report and Written Opinion for European Patent Application No. 06838070.8, dated Mar. 18, 2011, 7 pgs.
Office Action for European Patent Application No. 06838071.6, dated Mar. 18, 2011, 5 pgs.
Office Action for U.S. Patent Application No. 11/602,485, mailed Apr. 27, 2011, 16 pgs.
Office Action (with English translation) for Chinese Patent Application No. 200680050665.7 mailed Apr. 26, 2011, 11 pgs.
Office Action for U.S. Patent Application No. 11/948,585, mailed May 19, 2011, 10 pgs.
Notice of Allowance for U.S. Appl. No. 11/602,465, mailed Jun. 8, 2011, 6 pgs.
Office Action (with English translation) for Chinese Patent Application No. 200680045074.0, dated Jun. 2, 2011, 10 pgs.
Notice of Allowance for U.S. Appl. No. 11/602,464, mailed Jul. 11, 2011, 5 pgs.
Notice of Allowance for U.S. Appl. No. 11/602,508, mailed Jul. 20, 2011, 11 pgs.
Office Action (with English translation) for Chinese Patent Application No. 200680043297.3, dated Jul. 27, 2011, 8 pgs.
Office Action for Chinese Patent Application No. 200580039961.2, dated Aug. 9, 2011, 6 pgs.
European Search Report for European Patent Application No. 06844456.1, dated Jun. 28, 2011, 9 pgs.
Notice of Allowance for U.S. Appl. No. 11/602,472, mailed Sep. 8, 2011, 25 pgs.
English translation only of Office Action for Chinese Patent Application No. 200680050801.2 dated Aug. 31, 2011, 5 pgs.
European Search Report for European Patent Application No. 07836336.3, dated Sep. 19, 2011, 5 pgs.

(56) References Cited

OTHER PUBLICATIONS

English translation only of Office Action for Chinese Patent Application No. 200680051205.6, dated Oct. 10, 2011, 9 pgs.
Office Action for Korean Patent Application No. 10-2007-7014324, dated Oct. 31, 2011, 18 pgs.
English translation only of Office Action for Chinese Patent Application No. 200680050665.7 dated Nov. 23, 2011, 7 pgs.
Office Action for U.S. Appl. No. 12/218,325, mailed Dec. 13, 2011, 10 pgs.
English translation of Office Action for Chinese Patent Application No. 200680050801.2, dated Dec. 1, 2011, 3 pgs.
Office Action (with English translation) for Japanese Patent Application No. 2008-543354, mailed Dec. 22, 2011, 7 pgs.
Office Action (with English translation) for Chinese Patent Application No. 200680050814.X, dated Dec. 23, 2011, 6 pgs.
Office Action (with English translation) for Japanese Patent Application No. 2008-543355, mailed Jan. 5, 2012, 5 pgs.
Office Action (with English translation) for Japanese Patent Application No. 2008-541406, mailed Jan. 10, 2012, 11 pgs.
Office Action for U.S. Appl. No. 11/948,585, mailed Jan. 19, 2012, 11 pgs.
Office Action for Japanese Patent Application No. 2008-543344, mailed Feb. 2, 2012, 2 pgs.
Office Action for Japanese Patent Application No. 2008-544358, mailed Feb. 1, 2012, 3 pgs.
Office Action for Chinese Patent Application No. 200680051448.X, dated Feb. 21, 2012, 3 pgs.
Final Rejection for Japanese Patent Application No. 2007-543342, mailed Feb. 21, 2012, 8 pgs.
English translation for Office Action for Chinese Patent Application No. 200780046952.5, mailed Feb. 28, 2012, 5 pgs.
Office Action for U.S. Appl. No. 11/948,585, mailed Mar. 14, 2012, 14 pgs.
Notice of Allowance for U.S. Appl. No. 11/602,472, mailed Mar. 29, 2012, 4 pgs.
Office Action (with English translation) for Japanese Patent Application No. 2008-541407, mailed Mar. 27, 2012, 7 pgs.
Office Action (with English translation) for Japanese Patent Application No. 2008-543343, mailed Mar. 27, 2012, 6 pgs.
Office Action (with English translation) for Chinese Patent Application No. 200580039961.2, dated Apr. 12, 2012, 6 pgs.
Notice of Allowability for U.S. Appl. No. 11/666,124, mailed May 8, 2012, 9 pgs.
Office Action (with English translation) for Japanese Patent Application No. 2009-539238, mailed Apr. 24, 2012, 7 pgs.
Office Action (with English translation) for Taiwan Patent Application No. 094140888, mailed Mar. 20, 2012, 5 pgs.
Office Action (with English translation) for Korea Patent Application No. 10-2007-7014324, mailed May 18, 2012, 6 pgs.
Office Action for European Patent Application No. 07836336.3, mailed May 15, 2012, 5 pgs.
Office Action for Chinese Patent Application No. 200680051205.6, mailed May 24, 2012, 7 pgs.
Office Action (with English translation) for Japanese Patent Application No. 2008-543342, mailed Jun. 5, 2012, 8 pgs.
Office Action (with English translation) for Chinese Patent Application No. 200680050665.7, mailed Jul. 4, 2012, 12 pgs.
Notice of Allowance for U.S. Appl. No. 12/983,737, mailed Jul. 30, 2012, 9 pgs.
Notice of Allowance for Japanese Patent Application No. 2007-543342, dated Jul. 31, 2012, 3 pgs.
Office Action (with English translation) for Japanese Patent Application No. 2008-543354, mailed Jul. 24, 2012, 6 pgs.
Office Action (with English translation) and Search Report for Taiwan Patent Application No. 095142929, issued Aug. 17, 2012, 7 pgs.
Office Action for U.S. Appl. No. 12/218,325, mailed Aug. 28, 2012, 9 pgs.
Office Action (with English translation) for Taiwan Patent Application No. 095142926, issued Aug. 9, 2012, 12 pgs.
Office Action (with English translation) for Taiwan Patent Application No. 095142932, issued Aug. 17, 2012, 9 pgs.
Office Action (with English translation) for Taiwan Patent Application No. 095142928, issued Aug. 17, 2012, 9 pgs.
Office Action for U.S. Appl. No. 11/948,585, mailed Sep. 28, 2012, 18 pgs.
Office Action (with English translation) for Taiwan Patent Application No. 095143263, dated Aug. 17, 2012, 9 pgs.
Office Action (with English translation) for Japanese Patent Application No. 2008-541406, mailed Oct. 16, 2012, 7 pgs.
Office Action for U.S. Appl. No. 13/216,944, mailed Oct. 25, 2012, 12 pgs.
Notice of Allowance for U.S. Appl. No. 12/983,737, mailed Nov. 1, 2012, 7 pgs.
Office Action for Chinese Patent Application No. 200680051448.X, dated Nov. 2, 2012, 3 pgs.
Office Action (with English translation) for Taiwan Patent Application No. 095142923, dated Aug. 29, 2012, 9 pgs.
Office Action (with English translation) for Taiwan Patent Application No. 096106723, dated Sep. 21, 2012, 8 pgs.
Office Action (with English translation) for Japanese Patent Application No. 2008-544358, mailed Nov. 13, 2012, 2 pgs.
Office Action (with English translation) for Japanese Patent Application No. 2008-543344, mailed Nov. 13, 2012, 4 pgs.
Office Action (with English translation) for Japanese Patent Application No. 2008-543355, mailed Nov. 13, 2012, 4 pgs.
Notice of Allowance for U.S. Appl. No. 12/983,737, mailed Dec. 6, 2012, 5 pgs.
Office Action (with English translation) for Chinese Patent Application No. 200780046952.5, dated Dec. 4, 2012, 5 pgs.
Office Action (with English translation) for Taiwan Patent Application No. 094140888, dated Nov. 19, 2012, 6 pgs.
Office Action (with English translation) for Japanese Patent Application No. 2008-541407, mailed Dec. 21, 2012, 7 pgs.
Notice of Allowance for U.S. Appl. No. 12/218,325, mailed Jan. 24, 2013, 4 pgs.
Office Action (with English translation) for Japanese Patent Application No. 2009-539238, mailed Jan. 29, 2013, 5 pgs.
Office Action (with English translation) for Japanese Patent Application No. 2008-543354, mailed Jan. 29, 2013, 6 pgs.
Office Action (English translation only) for Korean Patent Application No. 10-2008-7015803, dated Feb. 13, 2013, 3 pgs.
Office Action (with English translation) for Korean Patent Application No. 10-2008-7013326, dated Feb. 13, 2013, 6 pgs.
Office Action for U.S. Appl. No. 13/615,926, mailed Mar. 15, 2013, 17 pgs.
Notice of Allowance for U.S. Appl. No. 13/216,944, mailed Mar. 19, 2013, 2 pgs.
Office Action (with English translation) for Korean Patent Application No. 10-2008-7015528, dated Apr. 22, 2013, 15 pgs.
Office Action for U.S. Appl. No. 11/948,585, mailed May 10, 2013, 12 pgs.
Office Action for U.S. Appl. No. 13/301,516, mailed Jun. 4, 2013, 8 pgs.
Office Action for U.S. Appl. No. 13/615,926, mailed Jun. 19, 2013, 17 pgs.
Notice of Allowance (with English translation of search report only) for Taiwan Patent Application No. 095142926, dated Jun. 26, 2013, 5 pgs.
Notice of AlloWance (with English translation of search report only) for Taiwan Patent Application No. 095142926, dated Jul. 1, 2013, 5 pgs.
Office Action (with English translation) for Japanese Patent Application No. 2011-168830, mailed Jul. 23, 2013, 6 pgs.
Office Action (with English translation) for Japanese Patent Application No. 2012-059979, mailed Jul. 23, 2013, 6 pgs.
Office Action (with English translation) for Japanese Patent Application No. 2012-085238, mailed Aug. 20, 2013, 7 pgs.
Office Action for U.S. Appl. No. 13/251,976, mailed Oct. 17, 2013, 11 pgs.
Office Action (with English translation) for Japanese Patent Application No. 2012-087168, mailed Sep. 24, 2013, 6 pgs.

(56) References Cited

OTHER PUBLICATIONS

Office Action (with English translation) for Taiwan Patent Application No. 095142930, issued Sep. 18, 2013, 8 pgs.
Office Action for U.S. Appl. No. 13/554,746, mailed Oct. 25, 2013, 10 pgs.
Office Action for U.S. Appl. No. 13/316,093, mailed Oct. 29, 2013, 7 pgs.
Notice of Allowance for U.S. Appl. Appl. No. 13/615,926, mailed Nov. 20, 2013, 5 pgs.
Notice of Allowance for U.S. Appl. No. 13/301,516, mailed Nov. 21, 2013, 5 pgs.
Office Action (with English translation) for Japanese Patent Application No. 2009-539238, mailed Dec. 3, 2013, 3 pgs.
Office Action (with English translation) for Japanese Patent Application No. 2013-018339, mailed Dec. 3, 2013, 7 pgs.
Notice of Allowance for U.S. Appl. No. 11/948,585, mailed Dec. 19, 2013, 5 pgs.
Office Action (with English translation) for Japanese Patent Application No. 2012-059979, mailed Dec. 17, 2013, 4 pgs.
Corrected Notice of Allowability for U.S. Appl. No. 13/615,926, mailed Feb. 4, 2014, 6 pgs.
Notice of Allowance for Japanese Patent Application. No. 2012-085238, dated Mar. 10, 2014, 3 pgs.
Office Action (with English translation) for Japanese Patent Application No. 2013-086392, mailed Mar. 3, 2014, 8 pgs.
Notice of Allowance for U.S. Appl. No. 11/602,485, mailed Sep. 1, 2011, 2 pgs.
Office Action (with English translation) for Taiwan Patent Application No. 101144065, dated Dec. 12, 2014, 13 pgs.
Office Action (with English translation) for Chinese Patent Application No. 201210151605.1, mailed Dec. 24, 2014, 6 pgs.
Office Action (with English translation) for Chinese Patent Application No. 201210151908.3, dated Jan. 5, 2015, 6 pgs.
Office Action (with English translation) for Chinese Patent Application No. 210310053498.3, dated Feb. 4, 2015, 15 pgs.
Office Action (with English translation) for Japanese Patent Application No. 2014-076996, dated Mar. 23, 2015, 9 pgs.
Office Action for U.S. Appl. No. 11/948,585, mailed May 7, 2015, 10 pgs.
Notice of Allowance for Taiwan Patent Application No. 102126755, dated May 21, 2015, 4 pgs.
Office Action (with English translation) for Chinese Patent Application No. 201210365592.8, dated May 18, 2015, 6 pgs.
Office Action for U.S. Appl. No. 14/019,163, mailed Sep. 14, 2015, 11 pgs.
Office Action (with English translation) for Japanese Patent Application No. 2014-203908, mailed Aug. 31, 2015, 4 pgs.
Office Action for U.S. Appl. No. 11/948,585, mailed Dec. 14, 2015, 12 pgs.
Office Action (with English translation) for Chinese Patent Application No. 201210365592.8, dated Nov. 24, 2015, 7 pgs.
Office Action (with English translation) for Japanese Patent Application No. 2014-233451 mailed Nov. 30, 2015, 11 pgs.
Notice of Allowance for U.S. Appl. No. 13/316,093, mailed Jan. 8, 2016, 4 pgs.
Office Action for U.S. Appl. No. 14/466,115, mailed Jan. 13, 2016, 13 pgs.
Office Action (with English translation) for Japanese Patent Application No. 2014-076996, dated Jan. 4, 2016, 9 pgs.
Office Action for U.S. Appl. No. 14/466,115, mailed Jun. 18, 2015, 12 pgs.
Notice of Allowance for Chinese Patent Application No. 201210151908.3, dated Jun. 25, 2015, 2 pgs.
Office Action (with English translation) for Chinese Patent Application No. 201210151605.1, dated Jun. 30, 2015, 10 pgs.
Extended European Search Report for European Patent Application No. 14192045.4, dated Jun. 15, 2015, 6 pgs.
Office Action for U.S. Appl. No. 13/316,093, mailed Jul. 15, 2015, 7 pgs.
Notice of Allowance for Taiwan Patent Application No. 101144065, dated Jun. 25, 2015, 3 pgs.
Notice of Allowance for Chinese Patent Application No. 201310053498.3, dated Jul. 30, 2015, 2 pgs.
Office Action for European Patent Application No. 06844456.1, dated Jul. 29, 2015, 4 pgs.

SYSTEM AND METHOD FOR POSITION CONTROL OF A MECHANICAL PISTON IN A PUMP

CROSS-REFERENCE TO RELATED APPLICATIONS

This application is a divisional application of U.S. patent application Ser. No. 13/301,516, filed Nov. 21, 2011, entitled "SYSTEM AND METHOD FOR POSITION CONTROL OF A MECHANICAL PISTON IN A PUMP," issued as U.S. Pat. No. 8,678,775, which is a divisional application of U.S. patent application Ser. No. 11/602,485, filed Nov. 20, 2006, entitled "SYSTEM AND METHOD FOR POSITION CONTROL OF A MECHANICAL PISTON IN A PUMP," issued as U.S. Pat. No. 8,083,498, which claims priority from U.S. Provisional Applications No. 60/741,660, filed Dec. 2, 2005, entitled "SYSTEM AND METHOD FOR POSITION CONTROL OF A MECHANICAL PISTON IN A PUMP" and No. 60/841,725, filed Sep. 1, 2006, entitled "SYSTEM AND METHOD FOR POSITION CONTROL OF A MECHANICAL PISTON IN A PUMP," all of which are incorporated herein by reference for all purposes.

TECHNICAL FIELD OF THE INVENTION

This invention relates generally to fluid pumps. More particularly, embodiments of the invention relate to system and method for position control of a mechanical piston in a motor-driven single-stage or multi-stage pump useful in semiconductor manufacturing.

BACKGROUND OF THE INVENTION

There are many applications for which precise control over the amount and/or rate at which a fluid is dispensed by a pumping apparatus is necessary. In semiconductor processing, for example, it is important to control the amount and rate at which photochemicals, such as photoresist chemicals, are applied to a semiconductor wafer. The coatings applied to semiconductor wafers during processing typically require a certain flatness and/or even thickness across the surface of the wafer that is measured in angstroms. The rates at which processing chemicals are applied (i.e., dispensed) onto the wafer have to be controlled carefully to ensure that the processing liquid is applied uniformly.

Photochemicals used in the semiconductor industry today are typically very expensive, costing as much as $1000 and up per a liter. Therefore, it is highly desirable to ensure that a minimum but adequate amount of chemical is used and that the chemical is not damaged by the pumping apparatus.

Unfortunately, these desirable qualities can be extremely difficult to achieve in today's pumping systems because of the many interrelated obstacles. For example, due to incoming supply issues, pressure can vary from system to system. Due to fluid dynamics and properties, pressure needs vary from fluid to fluid (e.g., a fluid with higher viscosity requires more pressure). In operation, vibration from various parts of a pumping system (e.g., a stepper motor) may adversely affect the performance of the pumping system, particularly in the dispensing phase. In pumping systems utilizing pneumatic pumps, when the solenoid comes on, it can cause large pressure spikes. In pumping systems utilizing multiple stage pumps, a small glitch in operation can also cause sharp pressure spikes in the liquid. Such pressure spikes and subsequent drops in pressure may be damaging to the fluid (i.e., may change the physical characteristics of the fluid unfavorably).

Additionally, pressure spikes can lead to build up fluid pressure that may cause a dispense pump to dispense more fluid than intended or dispense the fluid in a manner that has unfavorable dynamics. Furthermore, because these obstacles are interrelated, sometimes solving one may cause many more problems and/or make the matter worse.

Generally, pumping systems are unable to satisfactorily control pressure variation during a cycle. There is a need for a new pumping system with the ability to provide real time, smooth motion, and extremely precise and repeatable position control over fluid movements and dispense amounts. In particular, there is a need for precise and repeatable position control of a mechanical piston in a pump. Embodiments of the invention can address these needs and more.

SUMMARY OF THE INVENTION

Embodiments of the invention provide systems and methods for precise and repeatable position control of a mechanical piston in a pump that substantially eliminate or reduce the disadvantages of previously developed pumping systems and methods used in semiconductor manufacturing. More particularly, embodiments of the invention provide a pumping system with a motor-driven pump.

In one embodiment of the invention, the motor-driven pump is a dispense pump.

In embodiments of the invention, the dispense pump can be part of a multi-stage or single stage pump.

In one embodiment of the invention, a two-stage dispense pump is driven by a permanent-magnet synchronous motor (PMSM) and a digital signal processor (DSP) utilizing field-oriented control (FOC).

In one embodiment of the invention, the dispense pump is driven by a brushless DC motor (BLDCM) with a position sensor for real time position feedback.

Advantages of the embodiments of the invention disclosed herein include the ability to provide real time, smooth motion, and extremely precise and repeatable position control over fluid movements and dispense amounts.

An object of the invention is to reduce heat generation without undesirably compromising the precise position control of the dispense pump. This object is achievable in embodiments of the invention with a custom control scheme configured to increase the operating frequency of the motor's position control algorithm for critical functions such as dispensing and reduce the operating frequency to an optimal range for non-critical functions.

Another advantage provided by embodiments of the invention is the enhanced speed control. The custom control scheme disclosed herein can run the motor at very low speeds and still maintain a constant velocity, which enables the new pumping system disclosed herein to operate in a wide range of speeds with minimal variation, substantially increasing dispense performance and operation capabilities.

BRIEF DESCRIPTION OF THE DRAWINGS

A more complete understanding of the invention and the advantages thereof may be acquired by referring to the following description, taken in conjunction with the accompanying drawings in which like reference numbers indicate like features and wherein.

DETAILED DESCRIPTION

Preferred embodiments of the invention are described below with reference to the figures which are not necessarily drawn to scale and where like numerals are used to refer to like and corresponding parts of the various drawings.

Embodiments of the invention are directed to a pumping system with a multiple stage ("multi-stage") pump for feeding and dispensing fluid onto wafers during semiconductor manufacturing. Specifically, embodiments of the invention provide a pumping system implementing a multi-stage pump comprising a feed stage pump driven by a stepper motor and a dispense stage pump driven by a brushless DC motor for extremely accurate and repeatable control over fluid movements and dispense amounts of the fluid onto wafers. It should be noted that the multi-stage pump and the pumping system embodying such a pump as described herein are provided by way of example, but not limitation, and embodiments of the invention can be implemented for other multi-stage pump configurations. Embodiments of a motor driven pumping system with precise and repeatable position control will be described in more details below.

Figure 1:
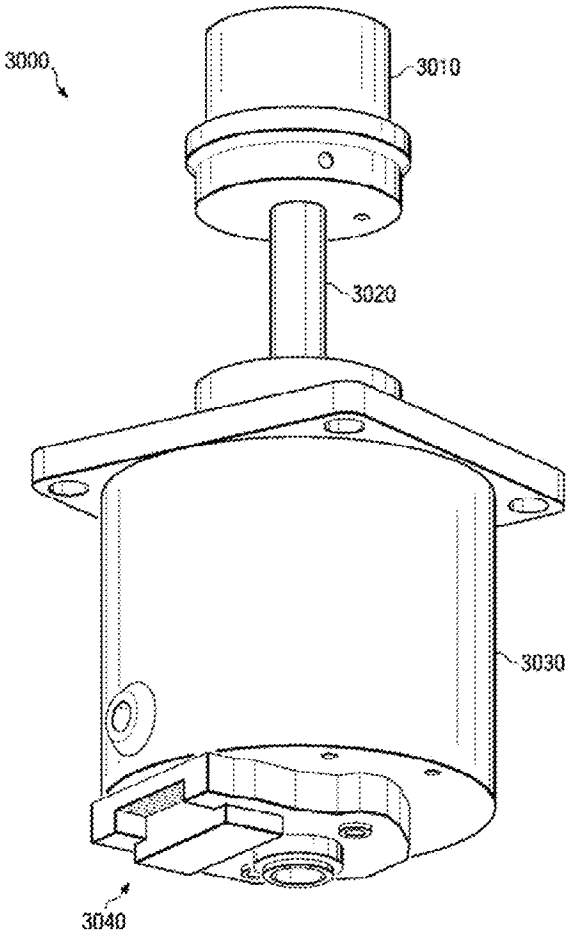
FIG. 1 is a diagrammatic representation of a motor assembly with a brushless DC motor, according to one embodiment of the invention.

FIG. 1 is a schematic representation of a motor assembly 3000 with a motor 3030 and a position sensor 3040 coupled thereto, according to one embodiment of the invention. In the example shown in FIG. 1, a diaphragm assembly 3010 is connected to motor 3030 via a lead screw 3020. In one embodiment, motor 3030 is a permanent magnet synchronous motor ("PMSM"). In a brush DC motor, the current polarity is altered by the commutator and brushes. However, in a PMSM, the polarity reversal is performed by power transistors switching in synchronization with the rotor position. Hence, a PMSM can be characterized as "brushless" and is considered more reliable than brush DC motors. Additionally, a PMSM can achieve higher efficiency by generating the rotor magnetic flux with rotor magnets. Other advantages of a PMSM include reduced vibration, reduced noises (by the elimination of brushes), efficient heat dissipation, smaller foot prints and low rotor inertia. Depending upon how the stator is wounded, the back-electromagnetic force, which is induced in the stator by the motion of the rotor, can have different profiles. One profile may have a trapezoidal shape and another profile may have a sinusoidal shape. Within this disclosure, the term PMSM is intended to represent all types of brushless permanent magnet motors and is used interchangeably with the term brushless DC motors ("BLDCM").

Figure 2:
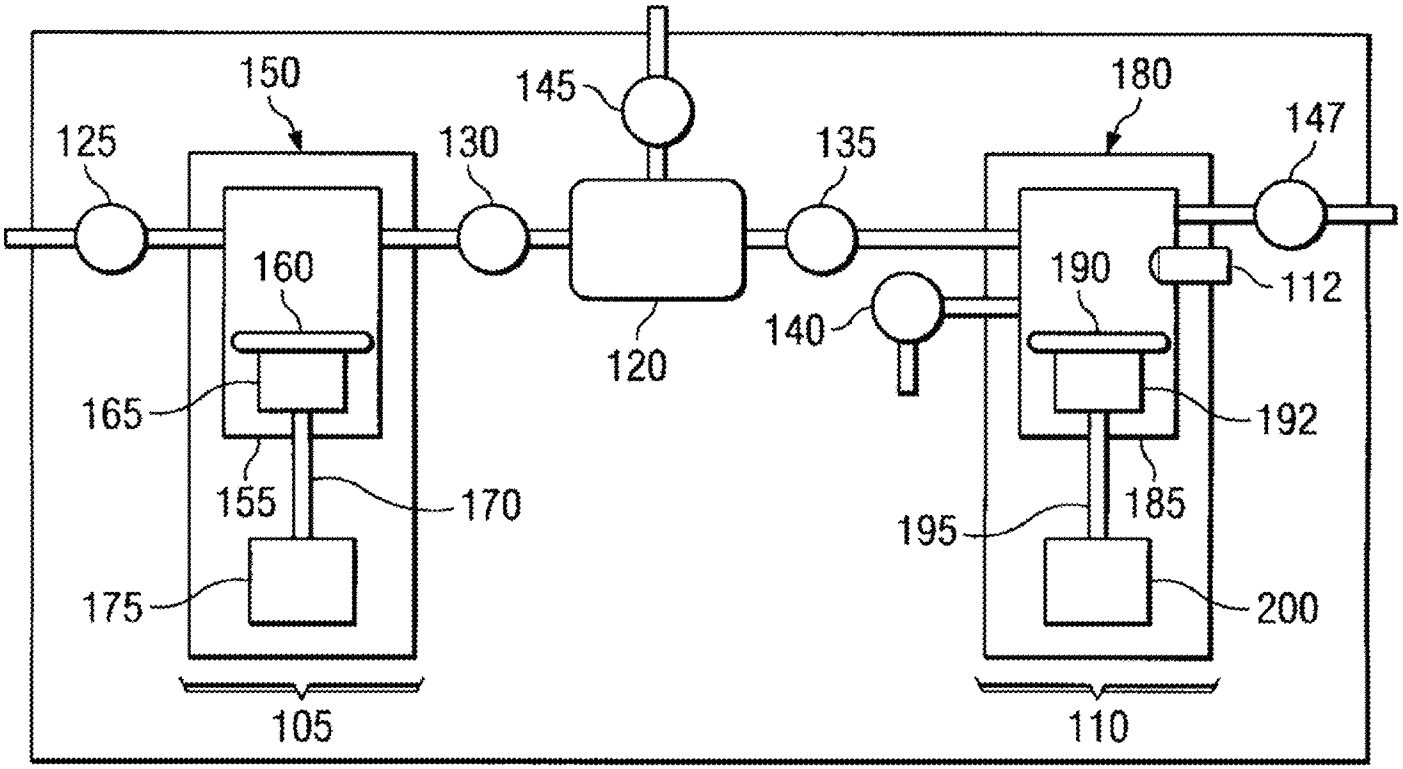
FIG. 2 is a diagrammatic representation of a multiple stage pump ("multi-stage pump") implementing a brushless DC motor, according to one embodiment of the invention.

In embodiments of the invention, BLDCM 3030 can be utilized as a feed motor and/or a dispense motor in a pump such as a multi-stage pump 100 shown in FIG. 2. In this example, multi-stage pump 100 includes a feed stage portion 105 and a separate dispense stage portion 110. Feed stage 105 and dispense stage 110 can include rolling diaphragm pumps to pump fluid in multi-stage pump 100. Feed-stage pump 150 ("feed pump 150"), for example, includes a feed chamber 155 to collect fluid, a feed stage diaphragm 160 to move within feed chamber 155 and displace fluid, a piston 165 to move feed stage diaphragm 160, a lead screw 170 and a feed motor 175. Lead screw 170 couples to feed motor 175 through a nut, gear or other mechanism for imparting energy from the motor to lead screw 170. Feed motor 175 rotates a nut that, in turn, rotates lead screw 170, causing piston 165 to actuate. Feed motor 175 can be any suitable motor (e.g., a stepper motor, BLDCM, etc.). In one embodiment of the invention, feed motor 175 implements a stepper motor.

Dispense-stage pump 180 ("dispense pump 180") may include a dispense chamber 185, a dispense stage diaphragm 190, a piston 192, a lead screw 195, and a dispense motor 200. Dispense motor 200 can be any suitable motor, including BLDCM. In one embodiment of the invention, dispense motor 200 implements BLDCM 3030 of FIG. 1. Dispense motor 200 can be controlled by a digital signal processor ("DSP") utilizing Field-Oriented Control ("FOC") at dispense motor 200, by a controller onboard multi-stage pump 100, or by a separate pump controller (e.g., external to pump 100). Dispense motor 200 can further include an encoder (e.g., a fine line rotary position encoder or position sensor 3040) for real time feedback of dispense motor 200's position. The use of a position sensor gives an accurate and repeatable control of the position of piston 192, which leads to accurate and repeatable control over fluid movements in dispense chamber 185. For, example, using a 2000 line encoder, which according to one embodiment gives 8000 pulses to the DSP, it is possible to accurately measure to and control at 0.045 degrees of rotation. In addition, a BLDCM can run at low velocities with little or no vibration. Dispense stage portion 110 can further include a pressure sensor 112 that determines the pressure of fluid at dispense stage 110. The pressure determined by pressure sensor 112 can be used to control the speed of the various pumps. Suitable pressure sensors include ceramic- and polymer-based piezoresistive and capacitive pressure sensors, including those manufactured by Metallux AG, of Korb, Germany.

Located between feed stage portion 105 and dispense stage portion 110, from a fluid flow perspective, is filter 120 to filter impurities from the process fluid. A number of valves (e.g., inlet valve 125, isolation valve 130, barrier valve 135, purge valve 140, vent valve 145 and outlet valve 147) can be appropriately positioned to control how fluid flows through multi-stage pump 100. The valves of multi-stage pump 100 are opened or closed to allow or restrict fluid flow to various portions of multi-stage pump 100. These valves can be pneumatically actuated (e.g., gas driven) diaphragm valves that open or close depending on whether pressure or a vacuum is asserted. Other suitable valves are possible.

Figure 4:
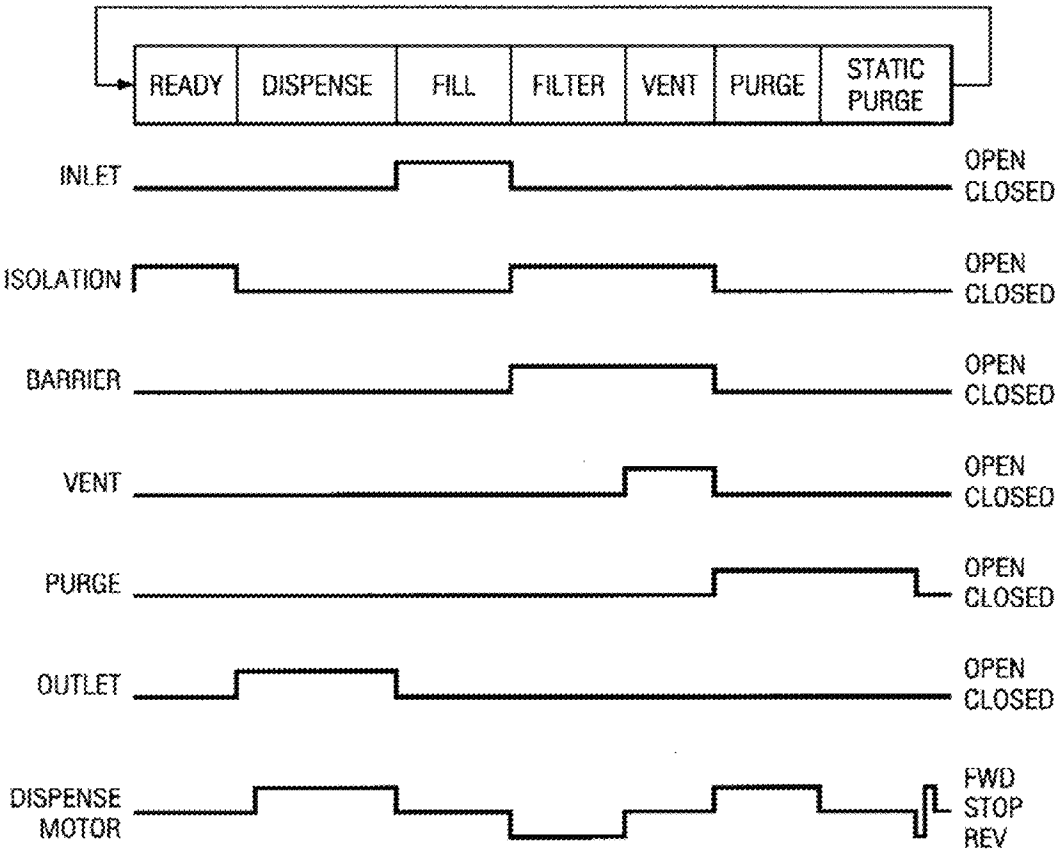
FIG. 4 is a diagrammatic representation of valve and motor timings for one embodiment of the invention.

In operation, multi-stage pump 100 can include a ready segment, dispense segment, fill segment, pre-filtration segment, filtration segment, vent segment, purge segment and static purge segment (see FIG. 4). During the feed segment, inlet valve 125 is opened and feed stage pump 150 moves (e.g., pulls) feed stage diaphragm 160 to draw fluid into feed chamber 155. Once a sufficient amount of fluid has filled feed chamber 155, inlet valve 125 is closed. During the filtration segment, feed-stage pump 150 moves feed stage diaphragm 160 to displace fluid from feed chamber 155. Isolation valve 130 and barrier valve 135 are opened to allow fluid to flow through filter 120 to dispense chamber 185. Isolation valve 130, according to one embodiment, can be opened first (e.g., in the "pre-filtration segment") to allow pressure to build in filter 120 and then barrier valve 135 opened to allow fluid flow into dispense chamber 185. According to other embodiments, both isolation valve 130 and barrier valve 135 can be opened and the feed pump moved to build pressure on the dispense side of the filter. During the filtration segment, dispense pump 180 can be brought to its home position. As described in the U.S. Provisional Patent Application No. 60/630,384, entitled "SYSTEM AND METHOD FOR A VARIABLE HOME POSITION DISPENSE SYSTEM" by Laverdiere, et al. filed Nov. 23, 2004, and International Application No. PCT/US2005/042127, entitled "SYSTEM AND METHOD FOR VARIABLE HOME POSITION DISPENSE SYSTEM", by Laverdiere et al., filed Nov. 21, 2005, published as International Publication No. WO 2006/057957 A2, and corresponding U.S. National Stage patent application Ser. No. 11/666,124, filed Sep. 30, 2008, issued as U.S. Pat. No. 8,292,598, all of which are incorporated herein by reference, the home position of the dispense pump can be a position that gives the greatest available volume at the dispense pump for the dispense cycle, but is less than the maximum available volume that the dispense pump could provide. The home position is selected based on various parameters for the dispense cycle to reduce unused hold up volume of multi-stage pump 100. Feed pump 150 can similarly be brought to a home position that provides a volume that is less than its maximum available volume.

As fluid flows into dispense chamber 185, the pressure of the fluid increases. The pressure in dispense chamber 185 can be controlled by regulating the speed of feed pump 150 as described in U.S. patent application Ser. No. 11/292,559, filed Dec. 2, 2005, now U.S. Pat. No. 7,850,431, entitled "SYSTEM AND METHOD FOR CONTROL OF FLUID PRESSURE," which is incorporated herein by reference. According to one embodiment of the invention, when the fluid pressure in dispense chamber 185 reaches a predefined pressure set point (e.g., as determined by pressure sensor 112), dispense stage pump 180 begins to withdraw dispense stage diaphragm 190. In other words, dispense stage pump 180 increases the available volume of dispense chamber 185 to allow fluid to flow into dispense chamber 185. This can be done, for example, by reversing dispense motor 200 at a predefined rate, causing the pressure in dispense chamber 185 to decrease. If the pressure in dispense chamber 185 falls below the set point (within the tolerance of the system), the rate of feed motor 175 is increased to cause the pressure in dispense chamber 185 to reach the set point. If the pressure exceeds the set point (within the tolerance of the system) the rate of feed motor 175 is decreased, leading to a lessening of pressure in downstream dispense chamber 185. The process of increasing and decreasing the speed of feed motor 175 can be repeated until the dispense stage pump reaches a home position, at which point both motors can be stopped.

According to another embodiment, the speed of the first-stage motor during the filtration segment can be controlled using a "dead band" control scheme. When the pressure in dispense chamber 185 reaches an initial threshold, dispense stage pump can move dispense stage diaphragm 190 to allow fluid to more freely flow into dispense chamber 185, thereby causing the pressure in dispense chamber 185 to drop. If the pressure drops below a minimum pressure threshold, the speed of feed motor 175 is increased, causing the pressure in dispense chamber 185 to increase. If the pressure in dispense chamber 185 increases beyond a maximum pressure threshold, the speed of feed motor 175 is decreased. Again, the process of increasing and decreasing the speed of feed motor 175 can be repeated until the dispense stage pump reaches a home position.

At the beginning of the vent segment, isolation valve 130 is opened, barrier valve 135 closed and vent valve 145 opened. In another embodiment, barrier valve 135 can remain open during the vent segment and close at the end of the vent segment. During this time, if barrier valve 135 is open, the pressure can be understood by the controller because the pressure in the dispense chamber, which can be measured by pressure sensor 112, will be affected by the pressure in filter 120. Feed-stage pump 150 applies pressure to the fluid to remove air bubbles from filter 120 through open vent valve 145. Feed-stage pump 150 can be controlled to cause venting to occur at a predefined rate, allowing for longer vent times and lower vent rates, thereby allowing for accurate control of the amount of vent waste. If feed pump is a pneumatic style pump, a fluid flow restriction can be placed in the vent fluid path, and the pneumatic pressure applied to feed pump can be increased or decreased in order to maintain a "venting" set point pressure, giving some control of an otherwise un-controlled method.

At the beginning of the purge segment, isolation valve 130 is closed, barrier valve 135, if it is open in the vent segment, is closed, vent valve 145 closed, and purge valve 140 opened and inlet valve 125 opened. Dispense pump 180 applies pressure to the fluid in dispense chamber 185 to vent air bubbles through purge valve 140. During the static purge segment, dispense pump 180 is stopped, but purge valve 140 remains open to continue to vent air. Any excess fluid removed during the purge or static purge segments can be routed out of multi-stage pump 100 (e.g., returned to the fluid source or discarded) or recycled to feed-stage pump 150. During the ready segment, inlet valve 125, isolation valve 130 and barrier valve 135 can be opened and purge valve 140 closed so that feed-stage pump 150 can reach ambient pressure of the source (e.g., the source bottle). According to other embodiments, all the valves can be closed at the ready segment.

During the dispense segment, outlet valve 147 opens and dispense pump 180 applies pressure to the fluid in dispense chamber 185. Because outlet valve 147 may react to controls more slowly than dispense pump 180, outlet valve 147 can be opened first and some predetermined period of time later dispense motor 200 started. This prevents dispense pump 180 from pushing fluid through a partially opened outlet valve 147. Moreover, this prevents fluid moving up the dispense nozzle caused by the valve opening (it's a mini-pump), followed by forward fluid motion caused by motor action. In other embodiments, outlet valve 147 can be opened and dispense begun by dispense pump 180 simultaneously.

An additional suckback segment can be performed in which excess fluid in the dispense nozzle is removed. During the suckback segment, outlet valve 147 can close and a secondary motor or vacuum can be used to suck excess fluid out of the outlet nozzle. Alternatively, outlet valve 147 can remain open and dispense motor 200 can be reversed to such fluid back into the dispense chamber. The suckback segment helps prevent dripping of excess fluid onto the wafer.

Figure 3:
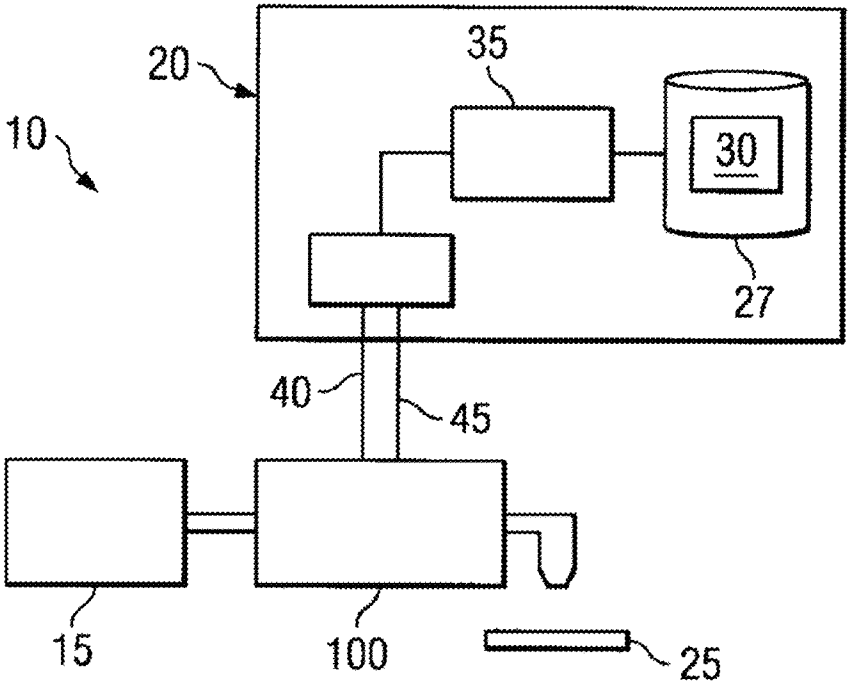
FIG. 3 is a diagrammatic representation of a pumping system implementing a multi-stage pump, according to one embodiment of the invention.

FIG. 3 is a diagrammatic representation of a pumping system 10 embodying multi-stage pump 100. Pumping system 10 can further include a fluid source 15 and a pump controller 20 which work together with multi-stage pump 100 to dispense fluid onto a wafer 25. The operation of multi-stage pump 100 can be controlled by pump controller 20. Pump controller 20 can include a computer readable medium 27 (e.g., RAM, ROM, Flash memory, optical disk, magnetic drive or other computer readable medium) containing a set of control instructions 30 for controlling the operation of multi-stage pump 100. A processor 35 (e.g., CPU, ASIC, RISC, DSP, or other processor) can execute the instructions. Pump controller 20 can be internal or external to pump 100. Specifically, pump controller may reside onboard multi-stage pump 100 or be connected to multi-stage pump 100 via one or more communications links for communicating control signals, data or other information. As an example, pump controller 20 is shown in FIG. 3 as communicatively coupled to multi-stage pump 100 via communications links 40 and 45. Communications links 40 and 45 can be networks (e.g., Ethernet, wireless network, global area network, DeviceNet network or other network known or developed in the art), a bus (e.g., SCSI bus) or other communications link. Pump controller 20 can be implemented as an onboard PCB board, remote controller or in other suitable manner. Pump controller 20 can include appropriate interfaces (e.g., network interfaces, I/O interfaces, analog to digital converters and other components) to allow pump controller 20 to communicate with multi-stage pump 100. Pump controller 20 can include a variety of computer components known in the art, including processors, memories, interfaces, display devices, peripherals or other computer components. Pump controller 20 can control various valves and motors in multi-stage pump to cause multi-stage pump to accurately dispense fluids, including low viscosity fluids (i.e., less than 100 centipoire) or other fluids. An I/O interface connector as described in U.S. Provisional Patent Application No. 60/741,657, entitled "I/O INTERFACE SYSTEM AND METHOD FOR A PUMP," by Cedrone et al., filed Dec. 2, 2005 and converted into U.S. patent application Ser. No. 11/602,449, now U.S. Pat. No. 7,940,664, and International Application No. PCT/US06/45127 filed Nov. 20, 2006, published as International Publication No. WO 2007/067354 A2, all of which are incorporated herein by reference, provides an I/O adapter that can be used to connected pump controller 20 to a variety of interfaces and manufacturing tools.

FIG. 4 provides a diagrammatic representation of valve and dispense motor timings for various segments of the operation of multi-stage pump 100. While several valves are shown as closing simultaneously during segment changes, the closing of valves can be timed slightly apart (e.g., 100 milliseconds) to reduce pressure spikes. For example, between the vent and purge segment, isolation valve 130 can be closed shortly before vent valve 145. It should be noted, however, other valve timings can be utilized in various embodiments of the invention. Additionally, several of the segments can be performed together (e.g., the fill/dispense stages can be performed at the same time, in which case both the inlet and outlet valves can be open in the dispense/fill segment). It should be further noted that specific segments do not have to be repeated for each cycle. For example, the purge and static purge segments may not be performed every cycle. Similarly, the vent segment may not be performed every cycle. Also, multiple dispenses can be performed before recharge.

The opening and closing of various valves can cause pressure spikes in the fluid. Closing of purge valve 140 at the end of the static purge segment, for example, can cause a pressure increase in dispense chamber 185. This can occur, because each valve may displace a small volume of fluid when it closes. Purge valve 140, for example, can displace a small volume of fluid into dispense chamber 185 as it closes. Because outlet valve 147 is closed when the pressure increases occur due to the closing of purge valve 140, "spitting" of fluid onto the wafer may occur during the subsequent dispense segment if the pressure is not reduced. To release this pressure during the static purge segment, or an additional segment, dispense motor 200 may be reversed to back out piston 192 a predetermined distance to compensate for any pressure increase caused by the closure of barrier valve 135 and/or purge valve 140. One embodiment of correcting for pressure increases caused by the closing of a valve (e.g., purge valve 140) is described in the U.S. Provisional Patent Application No. 60/741,681, entitled "SYSTEM AND METHOD FOR CORRECTING FOR PRESSURE VARIATIONS USING A MOTOR", by Gonnella et al., filed Dec. 2, 2005 and converted into U.S. patent application Ser. No. 11/602,472, issued as U.S. Pat No. 8,172,546, and International Application No. PCT/US06/45176 on Nov. 20, 2006, published as International Publication No. WO 2007/067359 A2, all of which are incorporated herein by reference.

Pressure spikes in the process fluid can also be reduced by avoiding closing valves to create entrapped spaces and opening valves between entrapped spaces. U.S. Provisional Patent Application No. 60/742,168, entitled "METHOD AND SYSTEM FOR VALVE SEQUENCING IN A PUMP," by Gonnella et al., filed Dec. 2, 2005 and converted into U.S. patent application Ser. No. 11/602,465, issued as U.S. Pat. No. 8,025,486, and International Application No. PCT/US06/44980 on Nov. 20, 2006, published as International Publication No. WO 2007/067342 A2, all of which are incorporated herein by reference, describes one embodiment for timing valve openings and closings to reduce pressure spikes in the process fluid.

It should be further noted that during the ready segment, the pressure in dispense chamber 185 can change based on the properties of the diaphragm, temperature or other factors. Dispense motor 200 can be controlled to compensate for this pressure drift as described in the U.S. Provisional Patent Application No. 60/741,682, entitled "SYSTEM AND METHOD FOR PRESSURE COMPENSATION IN A PUMP", by James Cedrone, filed Dec. 2, 2005 and converted into U.S. patent application Ser. No. 11/602,508 issued as U.S. Pat. No. 8,029,247, and International Application No. PCT/US06/45175 on Nov. 20, 2006, published as International Publication No. WO 2007/067358 A2, all of which are incorporated herein by reference. Thus, embodiments of the invention provide a multi-stage pump with gentle fluid handling characteristics that can avoid or mitigate potentially damaging pressure changes. Embodiments of the invention can also employ other pump control mechanisms and valve linings to help reduce deleterious effects of pressure on a process fluid. Additional examples of a pump assembly for multi-stage pump 100 can be found in U.S. patent application Ser. No. 11/051,576, filed Feb. 4, 2005 by Zagars et al., now U.S. Pat. No. 7,476,087, entitled "PUMP CONTROLLER FOR PRECISION PUMPING APPARATUS", which is incorporated herein by reference.

In one embodiment, multi-stage pump 100 incorporates a stepper motor as feed motor 175 and BLDCM 3030 as dispense motor 200. Suitable motors and associated parts may be obtained from EAD Motors of Dover, N.H., USA or the like. In operation, the stator of BLDCM 3030 generates a stator flux and the rotor generates a rotor flux. The interaction between the stator flux and the rotor flux defines the torque and hence the speed of BLDCM 3030. In one embodiment, a digital signal processor (DSP) is used to implement all of the field-oriented control (FOC). The FOC algorithms are realized in computer-executable software instructions embodied in a computer-readable medium. Digital signal processors, alone with on-chip hardware peripherals, are now available with the computational power, speed, and programmability to control the BLDCM 3030 and completely execute the FOC algorithms in microseconds with relatively insignificant add-on costs. One example of a DSP that can be utilized to implement embodiments of the invention disclosed herein is a 16-bit DSP available from Texas Instruments, Inc. based in Dallas, Tex., USA (part number TMS320F2812PGFA).

BLDCM 3030 can incorporate at least one position sensor to sense the actual rotor position. In one embodiment, the position sensor may be external to BLDCM 3030. In one embodiment, the position sensor may be internal to BLDCM 3030. In one embodiment, BLDCM 3030 may be sensorless. In the example shown in FIG. 1, position sensor 3040 is coupled to BLDCM 3030 for real time feedback of BLDCM 3030's actual rotor position, which is used by the DSP to control BLDCM 3030. An added benefit of having position sensor 3040 is that it proves extremely accurate and repeatable control of the position of a mechanical piston (e.g., piston 192 of FIG. 2), which means extremely accurately and repeatable control over fluid movements and dispense amounts in a piston displacement dispense pump (e.g., dispense pump 180 of FIG. 2). In one embodiment, position sensor 3040 is a fine line rotary position encoder. In one embodiment, position sensor 3040 is a 2000 line encoder. A 2000 line encoder can provide 8000 pulses or counts to a DSP, according to one embodiment of the invention. Using a 2000 line encoder, it is possible to accurately measure to and control at 0.045 degrees of rotation. Other suitable encoders can also be used. For example, position sensor 3040 can be a 1000 or 8000 line encoder.

BLDCM 3030 can be run at very low speeds and still maintain a constant velocity, which means little or no vibration. In other technologies such as stepper motors it has been impossible to run at lower speeds without introducing vibration into the pumping system, which was caused by poor constant velocity control. This variation would cause poor dispense performance and results in a very narrow window range of operation. Additionally, the vibration can have a deleterious effect on the process fluid. Table 1 below and FIGS. 5-9 compare a stepper motor and a BLDCM and demonstrate the numerous advantages of utilizing BLDCM 3030 as dispense motor 200 in multi-stage pump 100.

TABLE 1

| Item | Stepper Motor | BLDCM |
|---|---|---|
| Volume resolution (μl/step) | 1 | 0.1<br>10x improvement |
| Basic motion | Move, stop, wait, move, stop wait; Causes motor vibration and "dispense flicker" at low rates | Continuous motion, never stops |
| Motor current, Power | Current is set and power consumed for maximum conditions, whether required or not | Adaptable to load |
| Torque delivery | Low | High |
| Speed capability | 10-30x | 30,000x |

As can be seen from TABLE 1, compared to a stepper motor, a BLDCM can provide substantially increased resolution with continuous rotary motion, lower power consumption, higher torque delivery, and wider speed range. Note that, BLDCM resolution can be about 10 times more or better than what is provided by the stepper motor. For this reason, the smallest unit of advancement that can be provided by BLDCM is referred to as a "motor increment," distinguishable from the term "step", which is generally used in conjunction with a stepper motor. The motor increment is smallest measurable unit of movement as a BLDCM, according to one embodiment, can provide continuous motion, whereas a stepper motor moves in discrete steps.

Figure 5:
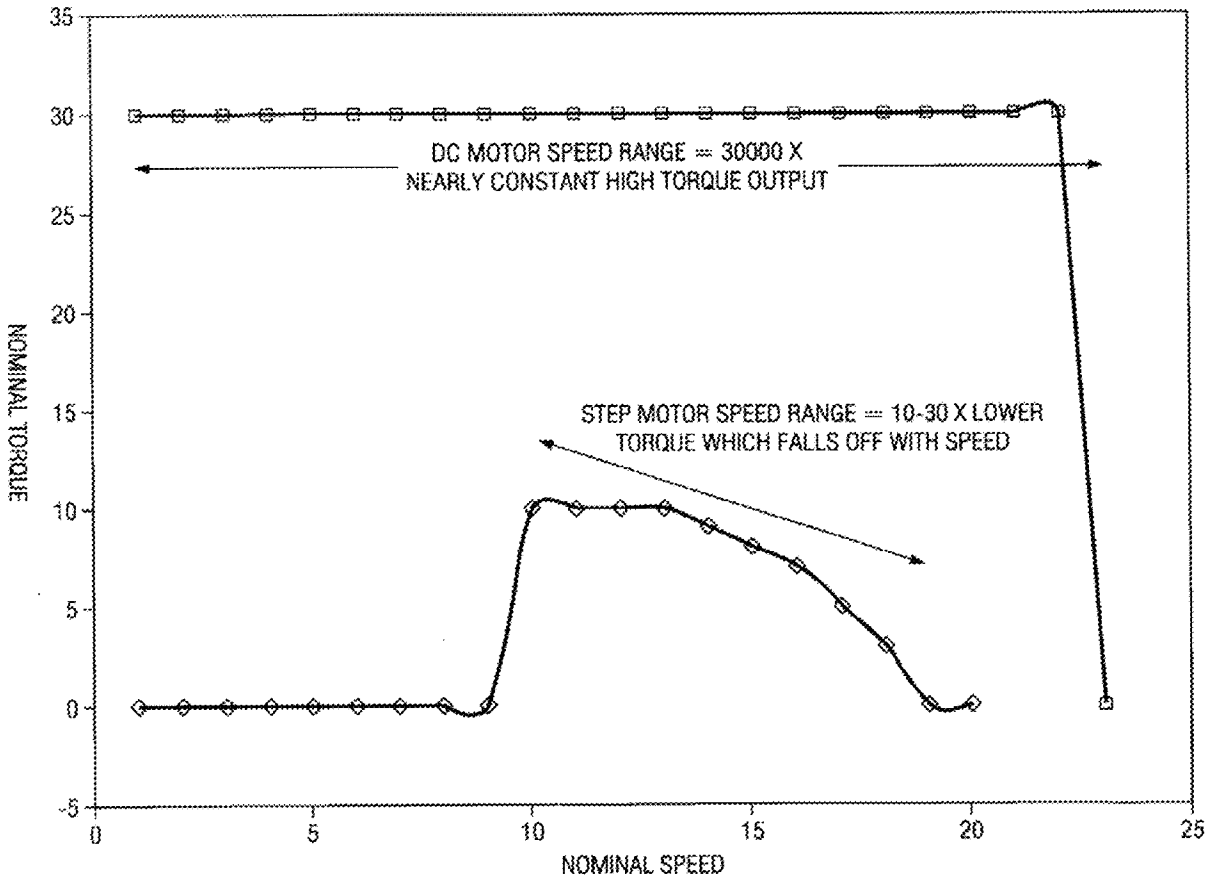
FIG. 5 is a plot diagram comparing average torque output and speed range of a brushless DC motor and a stepper motor, according to one embodiment of the invention.

FIG. 5 is a plot diagram comparing average torque output and speed range of a stepper motor and a BLDCM, according to one embodiment of the invention. As illustrated in FIG. 5, the BLDCM can maintain a nearly constant high torque output at higher speeds than those of the stepper motor. In addition, the speed range of the BLDCM is wider (e.g., about 1000 times or more) than that of the stepper motor. In contrast, the stepper motor tends to have lower torque output which tends to undesirably fall off with increased speed (i.e., torque output is reduced at higher speed).

Figure 6:
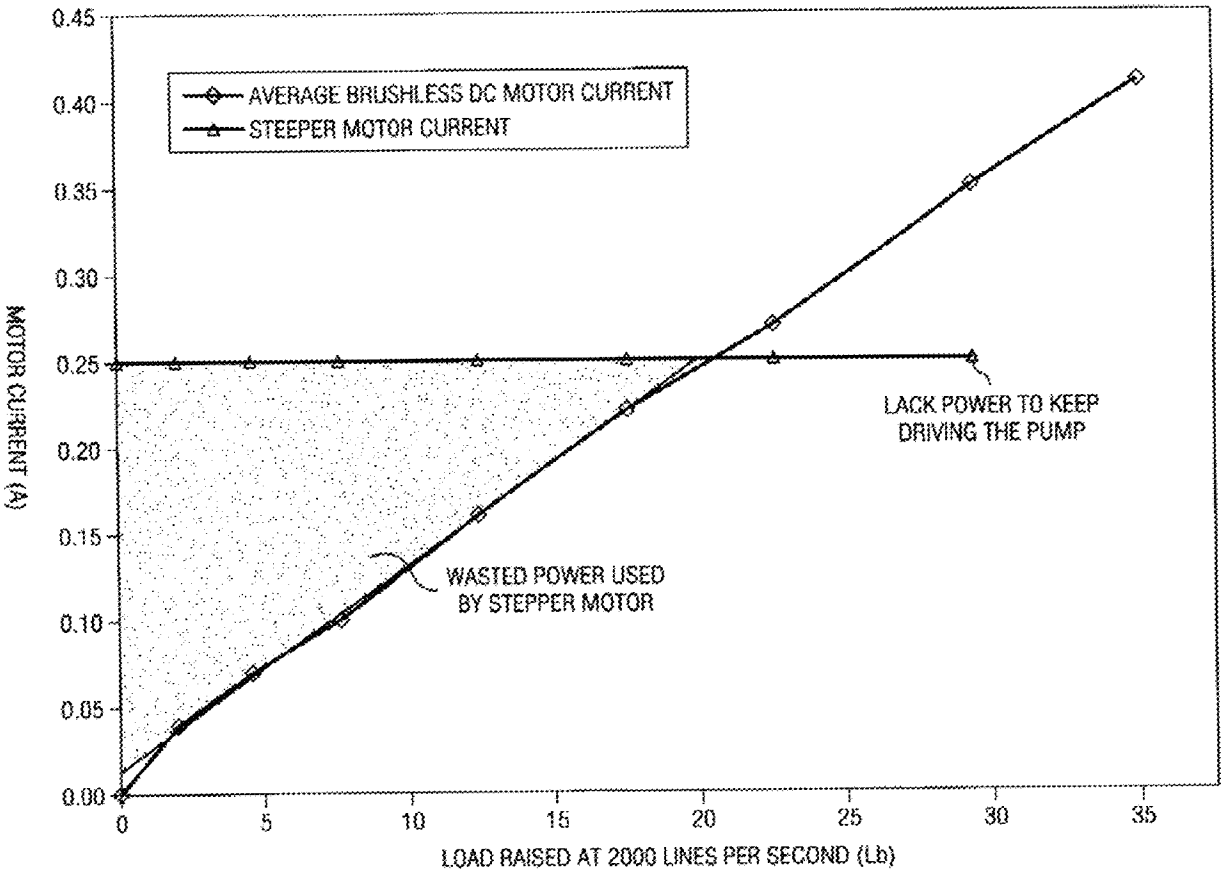
FIG. 6 is a plot diagram comparing average motor current and load between a brushless DC motor and a stepper motor, according to one embodiment of the invention.

FIG. 6 is a plot diagram comparing average motor current and load between a stepper motor and a BLDCM, according to one embodiment of the invention. As illustrated in FIG. 6, the BLDCM can adapt and adjust to load on system and only uses power required to carry the load. In contrast, whether it is required or not, the stepper motor uses current that is set for maximum conditions. For example, the peak current of a stepper motor is 150 milliamps (mA). The same 150 mA is used to move a 1-lb. load as well as a 10-lb. load, even though moving a 1-lb. load does not need as much current as a 10-lb. load. Consequently, in operation, the stepper motor consumes power for maximum conditions regardless of load, causing inefficient and wasteful use of energy.

With the BLDCM, current is adjusted with an increase or decrease in load. At any particular point in time, the BLDCM will self-compensate and supply itself with the amount of current necessary to turn itself at the speed requested and produce the force to move the load as required. The current can be very low (under 10 mA) when the motor is not moving. Because a BLDCM with control is self-compensating (i.e., it can adaptively adjust current according to load on system), it is always on, even when the motor is not moving. In comparison, the stepper motor could be turned off when the stepper motor is not moving, depending upon applications.

To maintain position control, the control scheme for the BLDCM needs to be run very often. In one embodiment, the control loop is run at 30 kHz, about 33 ms per cycle. So, every 33 ms, the control loop checks to see if the BLDCM is at the right position. If so, try not to do anything. If not, it adjusts the current and tries to force the BLDCM to the position where it should be. This rapid self-compensating action enables a very precise position control, which is highly desirable in some applications. Running the control loop at a speed higher (e.g., 30 kHz) than normal (e.g., 10 kHz) could mean extra heat generation in the system. This is because the more often the BLDCM switches current, the more opportunity to generate heat.

According to one aspect of the invention, in some embodiments the BLDCM is configured to take heat generation into consideration. Specifically, the control loop is configured to run at two different speeds during a single cycle. During the dispense portion of the cycle, the control loop is run at a higher speed (e.g., 30 kHz). During the rest of the non-dispense portion of the cycle, the control loop is run at a lower speed (e.g., 10 kHz). This configuration can be particularly useful in applications where super accurate position control during dispense is critical. As an example, during the dispense time, the control loop runs at 30 kHz, which provides an excellent position control. The rest of the time the speed is cut back to 10 kHz. By doing so, the temperature can be significantly dropped.

The dispense portion of the cycle could be customized depending upon applications. As another example, a dispense system may implement 20-second cycles. On one 20-second cycle, 5 seconds may be for dispensing, while the rest 15 seconds may be for logging or recharging, etc. In between cycles, there could be a 15-20 seconds ready period. Thus, the control loop of the BLDCM would run a small percentage of a cycle (e.g., 5 seconds) at a higher frequency (e.g., 30 kHz) and a larger percentage (e.g., 15 seconds) at a lower frequency (e.g., 10 kHz).

As one skilled in the art can appreciate, these parameters (e.g., 5 seconds, 15 seconds, 30 kHz, 10 kHz. etc.) are meant to be exemplary and non-limiting. Operating speed and time can be adjusted or otherwise configured to suit so long as they are within the scope and spirit of the invention disclosed herein. Empirical methodologies may be utilized in determining these programmable parameters. For example, 10 kHz is a fairly typical frequency to drive the BLDCM. Although a different speed could be used, running the control loop of the BLDCM slower than 10 kHz could run the risk of losing position control. Since it is generally difficult to regain the position control, it is desirable for the BLDCM to hold the position.

One goal of this aspect of the invention is to reduce speed as much as possible during the non-dispense phase of the cycle without undesirably compromising the position control. This goal is achievable in embodiments disclosed herein via a custom control scheme for the BLDCM. The custom control scheme is configured to increase the frequency (e.g., 30 kHz) in order to gain some extra/increased position control for critical functions such as dispensing. The custom control scheme is also configured to reduce heat generation by allowing non-critical functions to be run at a lower frequency (e.g., 10 kHz). Additionally, the custom control scheme is configured to minimize any position control losses caused by running at the lower frequency during the non-dispense cycle.

Figure 7:
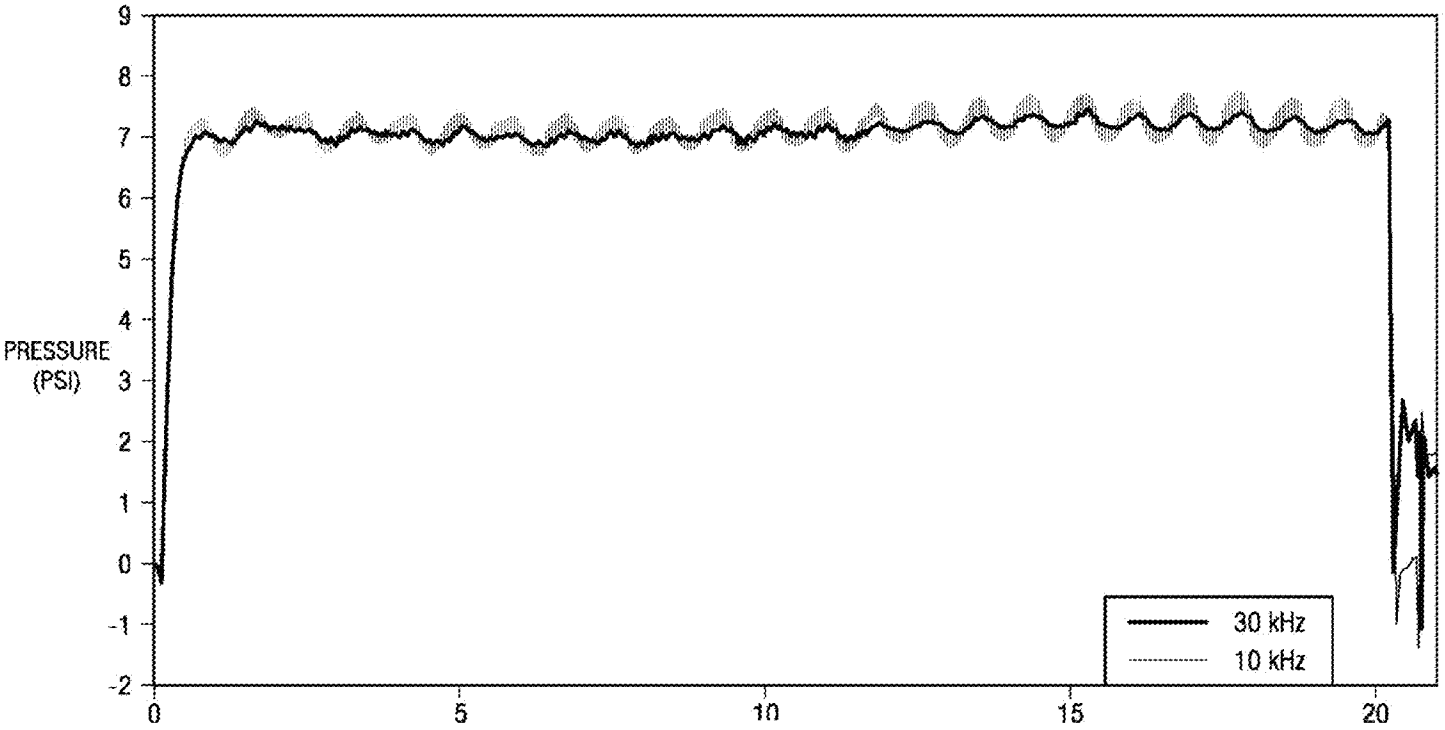
FIG. 7 is a plot diagram showing the difference between 30 kHz motor operation and 10 kHz motor operation.

The custom control scheme is configured to provide a desirable dispense profile, which can be characterized by pressure. The characterization can be based on deviation of the pressure signal. For example, a flat pressure profile would suggest smooth motion, less vibration, and therefore better position control. Contrastingly, deviating pressure signals would suggest poor position control. FIG. 7 is a plot diagram which exemplifies the difference between 30 kHz motor operation and 10 kHz motor operation (10 mL at 0.5 mL/s). The first 20 second is the dispense phase. As it can be seen in FIG. 7, during the dispense phase, dispensing at 30 kHz has a pressure profile that is less noisy and smoother than that of dispensing at 10 kHz.

As far as position control is concerned, the difference between running the BLDCM at 10 kHz and at 15 kHz can be insignificant. However, if the speed drops below 10 kHz (e.g., 5 kHz), it may not be fast enough to retain good position control. For example, one embodiment of the BLDCM is configured for dispensing fluids. When the position loop runs under 1 ms (i.e., at about 10 kHz or more), no effects are visible to the human eye. However, when it gets up to the 1, 2, or 3 ms range, effects in the fluid become visible. As another example, if the timing of the valve varies under 1 ms, any variation in the results of the fluid may not be visible to the human eye. In the 1, 2, or 3 ms range, however, the variations can be visible. Thus, the custom control scheme preferably runs time critical functions (e.g., timing the motor, valves, etc.) at about 10 kHz or more.

Another consideration concerns internal calculations in the dispense system. If the dispense system is set to run as slow as 1 kHz, then there is not any finer resolution than 1 ms and no calculations that need to be finer than 1 ms can be performed. In this case, 10 kHz would be a practical frequency for the dispense system. As described above, these numbers are meant to be exemplary. It is possible to set the speed lower than 10 kHz (e.g., 5 or even 2 kHz).

Similarly, it is possible to set the speed higher than 30 kHz, so long as it satisfies the performance requirement. The exemplary dispense system disclosed herein uses an encoder which has a number of lines (e.g., 8000 lines). The time between each line is the speed. Even if the BLDCM is running fairly slowly, these are very fine lines so they can come very fast, basically pulsing to the encoder. If the BLDCM runs one revolution per a second, that means 8000 lines and hence 8000 pulses in that second. If the widths of the pulses do not vary (i.e., they are right at the target width and remain the same over and over), it is an indication of a very good speed control. If they oscillate, it is an indication of a poorer speed control, not necessarily bad, depending on the system design (e.g., tolerance) and application.

Another consideration concerns the practical limit on the processing power of a digital signal processor (DSP). As an example, to dispense in one cycle, it may take almost or just about 20 μs to perform all the necessary calculations for the position controller, the current controllers, and the like. Running at 30 kHz gives about 30 μs, which is sufficient to do those calculations with time left to run all other processes in the controllers. It is possible to use a more powerful processor that can run faster than 30 kHz. However, operating at a rate faster than 30 μs results a diminishing return. For example, 50 kHz only gives about 20 μs ($1/50000$ Hz=0.00002 s=20 μs). In this case, a better speed performance can be obtained at 50 kHz, but the system has insufficient time to conduct all the processes necessary to run the controllers, thus causing a processing problem. What is more, running 50 kHz means that the current will switch that much more often, which contributes to the aforementioned heat generation problem.

In summary, to reduce the heat output, one solution is to configure the BLDCM to run at a higher frequency (e.g., 30 kHz) during dispensing and drop down or cut back to a lower frequency (e.g., 10 kHz) during non-dispensing operations (e.g., recharge). Factors to consider in configuring the custom control scheme and associated parameters include position control performance and speed of calculation, which relates to the processing power of a processor, and heat generation, which relates to the number of times the current is switched after calculation. In the above example, the loss of position performance at 10 kHz is insignificant for non-dispense operations, the position control at 30 kHz is excellent for dispensing, and the overall heat generation is significantly reduced. By reducing the heat generation, embodiments of the invention can provide a technical advantage in preventing temperature changes from affecting the fluid being dispensed. This can be particularly useful in applications involving dispensing sensitive and/or expensive fluids, in which case, it would be highly desirable to avoid any possibility that heat or temperature change may affect the fluid. Heating a fluid can also affect the dispense operation. One such effect is called the natural suck-back effect. The suck-back effect explains that when the dispense operation warms, it expands the fluid. As it starts to cool outside the pump, the fluid contracts and is retracted from the end of the nozzle. Therefore, with the natural suck-back effect the volume may not be precise and may be inconsistent.

Figure 8:
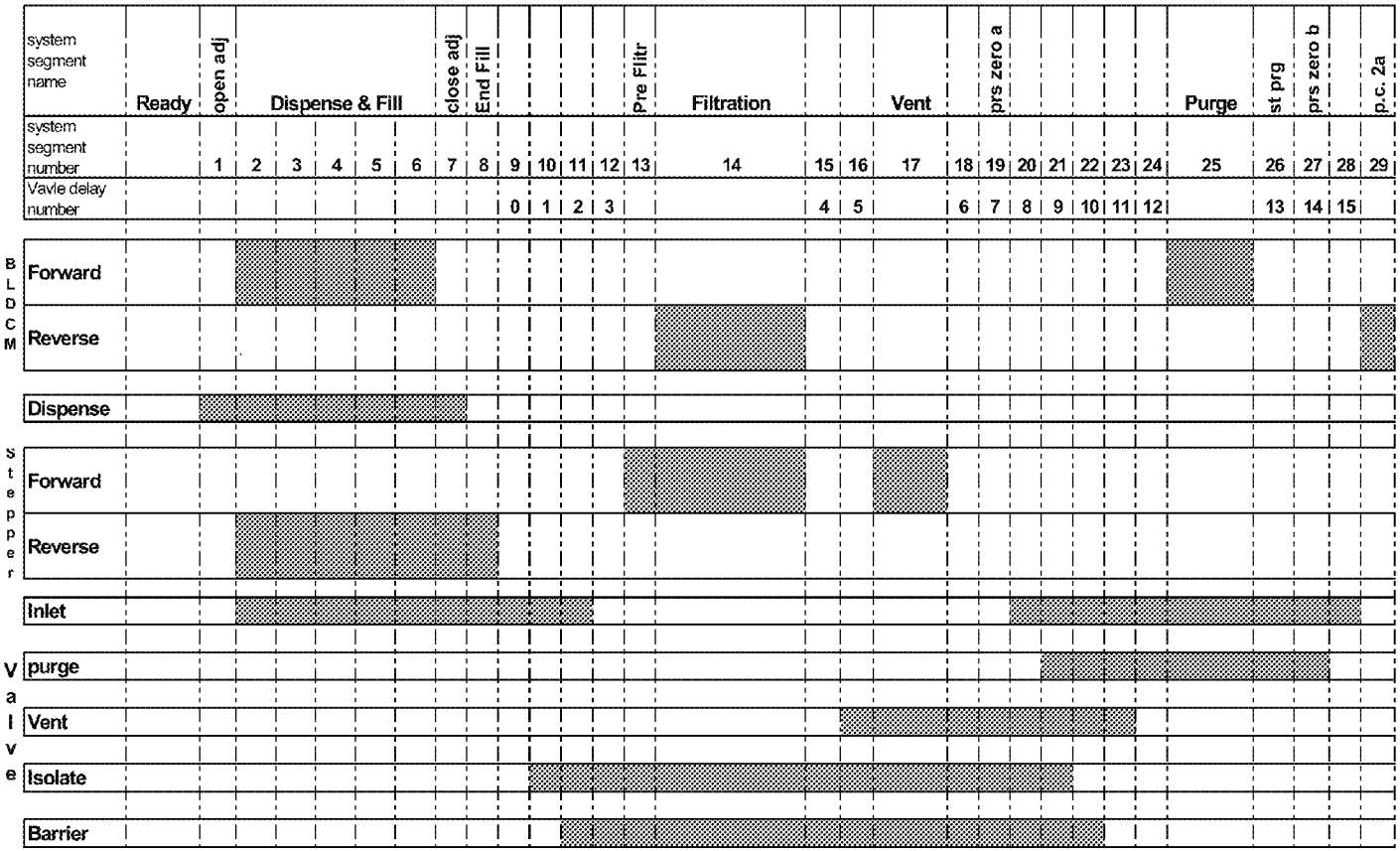
FIG. 8 is a chart diagram illustrating cycle timing of a brushless DC motor and a stepper motor in various stages, according to one embodiment of the invention.

FIG. 8 is a chart diagram illustrating cycle timing of a stepper motor and a BLDCM in various stages, according to one embodiment of the invention. Following the above example, the stepper motor implements feed motor 175 and the BLDCM implements dispense motor 200. The shaded area in FIG. 8 indicates that the motor is in operation. According to one embodiment of the invention, the stepper motor and the BLDCM can be configured in a manner that facilitates pressure control during the filtration cycle. One example of the pressure control timing of the stepper motor and the BLDCM is provided in FIG. 9 where the shaded area indicates that the motor is in operation.

Figure 9:
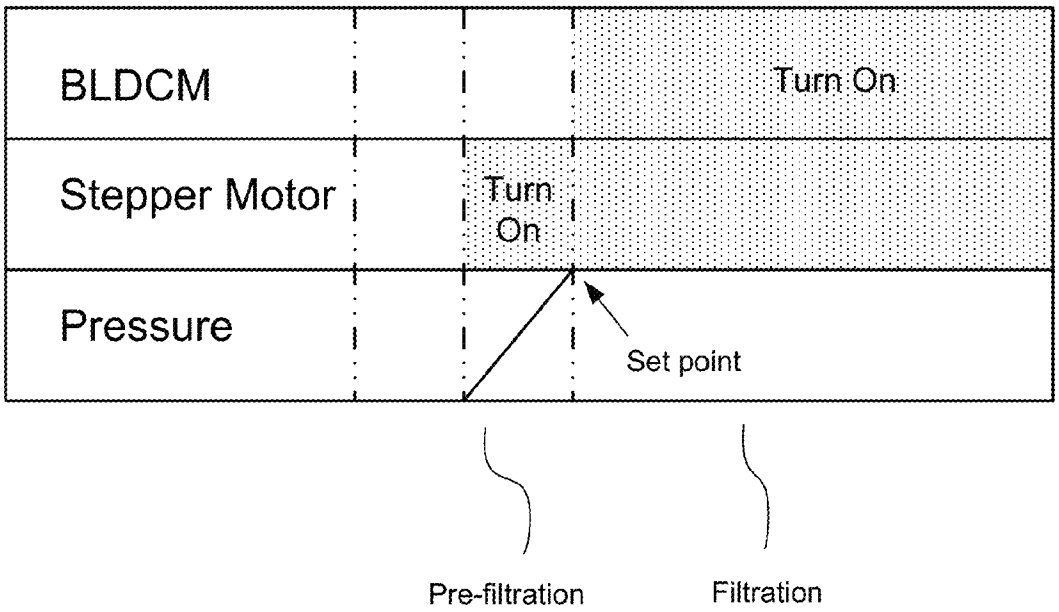
FIG. 9 is a chart diagram exemplifying the pressure control timing of a stepper motor and a brushless DC motor at the start of a filtration process, according to one embodiment of the invention.

FIGS. 8 and 9 illustrate an exemplary configuration of feed motor 175 and dispense motor 200. More specifically, once the set point is reached, the BLDCM (i.e., dispense motor 200) can start reversing at the programmed filtration rate. In the meantime, the stepper motor (i.e., feed motor 175) rate varies to maintain the set point of pressure signal. This configuration provides several advantages. For instance, there are no pressure spikes on the fluid, the pressure on the fluid is constant, no adjustment is required for viscosity changes, no variation from system to system, and vacuum will not occur on the fluid.

Figure 10:
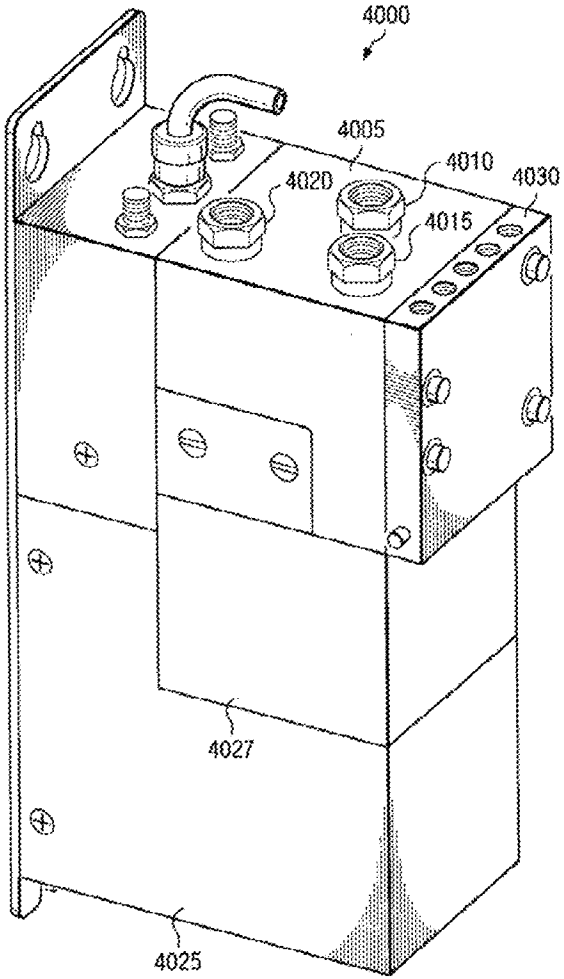
FIG. 10 is a diagrammatic representation of a single stage pump implementing a brushless DC motor, according to one embodiment of the invention.

Although described in terms of a multi-stage pump, embodiments of the invention can also implement a single stage pump. FIG. 10 is a diagrammatic representation of a pump assembly for a pump 4000. Pump 4000 can be similar to one stage, say the dispense stage, of multi-stage pump 100 described above and can include a single chamber and a rolling diaphragm pump driven by embodiments of a BLDCM as described herein, with the same or similar control scheme for position control. Pump 4000 can include a dispense block 4005 that defines various fluid flow paths through pump 4000 and at least partially defines a pump chamber. Dispense pump block 4005 can be a unitary block of PTFE, modified PTFE or other material. Because these materials do not react with or are minimally reactive with many process fluids, the use of these materials allows flow passages and the pump chamber to be machined directly into dispense block 4005 with a minimum of additional hardware. Dispense block 4005 consequently reduces the need for piping by providing an integrated fluid manifold.

Dispense block 4005 can also include various external inlets and outlets including, for example, inlet 4010 through which the fluid is received, purge/vent outlet 4015 for purging/venting fluid, and dispense outlet 4020 through which fluid is dispensed during the dispense segment. Dispense block 4005, in the example of FIG. 10, includes the external purge outlet 4010 as the pump only has one chamber. U.S. Provisional Patent Application No. 60/741,667, entitled "0-RING-LESS LOW PROFILE FITTING AND ASSEMBLY THEREOF" by Iraj Gashgaee, filed Dec. 2, 2005 and converted into U.S. patent application Ser. No. 11/602,513 and International Application No. PCT/US06/44981 on Nov. 20, 2006, all of which are hereby fully incorporated by reference herein, describes embodiments of o-ring-less fittings that can be utilized to connect the external inlets and outlets of dispense block 4005 to fluid lines.

Dispense block 4005 routes fluid from the inlet to an inlet valve (e.g., at least partially defined by valve plate 4030), from the inlet valve to the pump chamber, from the pump chamber to a vent/purge valve and from the pump chamber to outlet 4020. A pump cover 4225 can protect a pump motor from damage, while piston housing 4027 can provide protection for a piston and can be formed of polyethylene or other polymer. Valve plate 4030 provides a valve housing for a system of valves (e.g., an inlet valve, and a purge/vent valve) that can be configured to direct fluid flow to various components of pump 4000. Valve plate 4030 and the corresponding valves can be formed similarly to the manner described in conjunction with valve plate 230, discussed above. Each of the inlet valve and the purge/vent valve is at least partially integrated into valve plate 4030 and is a diaphragm valve that is either opened or closed depending on whether pressure or vacuum is applied to the corresponding diaphragm. Alternatively, some of the valves may be external to dispense block 4005 or arranged in additional valve plates. In the example of FIG. 10, a sheet of PTFE is sandwiched between valve plate 4030 and dispense block 4005 to form the diaphragms of the various valves. Valve plate 4030 includes a valve control inlet (not shown) for each valve to apply pressure or vacuum to the corresponding diaphragm.

As with multi-stage pump 100, pump 4000 can include several features to prevent fluid drips from entering the area of multi-stage pump 100 housing electronics. The "drip proof" features can include protruding lips, sloped features, seals between components, offsets at metal/polymer interfaces and other features described above to isolate electronics from drips. The electronics and manifold can be configured similarly to the manner described above to reduce the effects of heat on fluid in the pump chamber.

Thus, embodiments of the systems and methods disclosed herein can utilize a BLDCM to drive a single-stage or a multi-stage pump in a pumping system for real time, smooth motion, and extremely precise and repeatable position control over fluid movements and dispense amounts, useful in semiconductor manufacturing. The BLDCM may employ a position sensor for real time position feedback to a processor executing a custom FOC scheme. The same or similar FOC scheme is applicable to single-stage and multi-stage pumps.

Although the invention has been described in detail herein with reference to the illustrative embodiments, it should be understood that the description is by way of example only and is not to be construed in a limiting sense. It is to be further understood, therefore, that numerous changes in the details of the embodiments of this invention and additional embodiments of this invention will be apparent to, and may be made by, persons of ordinary skill in the art having reference to this description. It is contemplated that all such changes and additional embodiments are within the scope and spirit of this invention. Accordingly, the scope of the invention should be determined by the following claims and their legal equivalents.

What is claimed is:

1. A method, comprising:

connecting a brushless DC motor to a mechanical piston in a pump having an inlet and an outlet;

configuring a controller for controlling the brushless DC motor and directing a fluid from the inlet of the pump to the outlet of the pump, the controller having a non-transitory computer-readable medium carrying software instructions for controlling the pump and a processor communicatively coupled to the non-transitory computer-readable medium and the pump; and the controller controlling a position of the mechanical piston in the pump by controlling an operating frequency of a position control loop for the brushless DC motor;

wherein the position control loop is configured to run at a first frequency during a dispensing operation of the pump for a first level of position control of the brushless DC motor and to run at a second frequency during a non-dispensing operation of the pump for a second level of position control of the brushless DC motor.

2. The method according to claim 1, wherein the first frequency is higher than the second frequency.

3. The method according to claim 1, further comprising:

providing real time position information for the mechanical piston to the controller.

4. The method according to claim 1, further comprising:

controlling the brushless DC motor to run at the first frequency and the second frequency during a single cycle.

5. The method according to claim 4, wherein the dispensing operation of the pump comprises a dispense portion of the single cycle and wherein the non-dispensing operation of the pump comprises a non-dispense portion of the single cycle.

6. The method according to claim 1, wherein the controlling further comprises increasing an operating frequency of the brushless DC motor to reach the first frequency.

7. The method according to claim 6, wherein the first frequency is about 30 kHz.

8. The method according to claim 1, wherein the controlling further comprises decreasing an operating frequency of the brushless DC motor to reach the second frequency.

9. The method according to claim 8, wherein the second frequency is about 10 kHz.

10. The method according to claim 1, wherein the controlling further comprises changing an operating frequency of the brushless DC motor to accommodate a change in pump function.

11. A computer program product comprising at least one non-transitory computer readable medium storing instructions translatable by a processor of a controller to perform:

directing a fluid from an inlet of a pump to an outlet of the pump, wherein the processor is communicatively coupled to the at least one non-transitory computer-readable medium and the pump; and controlling a position of a mechanical piston in the pump by controlling an operating frequency of a position control loop for a brushless DC motor connected to the mechanical piston in the pump;

wherein the position control loop is configured to run at a first frequency during a dispensing operation of the pump for a first level of position control of the brushless DC motor and to run at a second frequency during a non-dispensing operation of the pump for a second level of position control of the brushless DC motor.

12. The computer program product of claim 11, wherein the first frequency is higher than the second frequency.

13. The computer program product of claim 11, wherein the at least one non-transitory computer readable medium further stores instructions translatable by the controller to perform:

receiving real time position information for a mechanical piston in the pump.

14. The computer program product of claim 11, wherein the at least one non-transitory computer readable medium further stores instructions translatable by the controller to perform:

controlling the brushless DC motor to run at the first frequency and the second frequency during a single cycle.

15. The computer program product of claim 14, wherein the dispensing operation of the pump comprises a dispense portion of the single cycle and wherein the non-dispensing operation of the pump comprises a non-dispense portion of the single cycle.

16. The computer program product of claim 11, wherein the controlling further comprises increasing an operating frequency of the brushless DC motor to reach the first frequency.

17. The computer program product of claim 16, wherein the first frequency is about 30 kHz.

18. The computer program product of claim 11, wherein the controlling further comprises decreasing an operating frequency of the brushless DC motor to reach the second frequency.

19. The computer program product of claim 18, wherein the second frequency is about 10 kHz.

20. The computer program product of claim 11, wherein the controlling further comprises changing an operating frequency of the brushless DC motor to accommodate a change in pump function.

* * * * *